US009028377B2

(12) United States Patent
Hood

(10) Patent No.: US 9,028,377 B2
(45) Date of Patent: May 12, 2015

(54) EXERCISE AND TRAINING APPARATUSES AND METHODS OF MAKING AND USING THE SAME

(76) Inventor: Ronald Hood, Taylorville, IL (US)

( * ) Notice: Subject to any disclaimer, the term of this patent is extended or adjusted under 35 U.S.C. 154(b) by 412 days.

(21) Appl. No.: 13/481,230

(22) Filed: May 25, 2012

(65) Prior Publication Data

US 2012/0322630 A1 Dec. 20, 2012

Related U.S. Application Data

(60) Provisional application No. 61/489,759, filed on May 25, 2011.

(51) Int. Cl.

| | |
|---|---|
| ***A63B 21/00*** | (2006.01) |
| ***A63B 21/02*** | (2006.01) |
| ***A63B 21/06*** | (2006.01) |
| ***A63B 21/072*** | (2006.01) |
| ***A63B 22/20*** | (2006.01) |
| ***A63B 23/16*** | (2006.01) |

(52) U.S. Cl.

CPC ..... *A63B 21/023* (2013.01); *A63B 21/0615* (2013.01); *A63B 21/0724* (2013.01); *A63B 21/1469* (2013.01); *A63B 21/1488* (2013.01); *A63B 21/1492* (2013.01); *A63B 21/151* (2013.01); *A63B 22/20* (2013.01); *A63B 23/16* (2013.01)

(58) Field of Classification Search

USPC ..... 482/126, 121, 128, 148, 108, 110

See application file for complete search history.

(56) References Cited

U.S. PATENT DOCUMENTS

| | | | | | |
|---|---|---|---|---|---|
| 818,242 | A | * | 4/1906 | Geisel | 482/128 |
| 3,544,106 | A | * | 12/1970 | Barrett | 482/126 |
| 4,978,122 | A | | 12/1990 | Dibowski | |

* cited by examiner

*Primary Examiner* — Jerome W Donnelly

(74) *Attorney, Agent, or Firm* — Scherrer Patent & Trademark Law, P.C.; Stephen T. Scherrer; Monique A. Morneault

(57) ABSTRACT

The present invention relates to apparatuses for increasing strength through exercise and training. Specifically, the present invention relates to apparatuses that increase the difficulty of well-known exercises and weight lifting techniques in order to increase the efficiency of work-outs. More specifically, the present invention relates to apparatuses that promote whole-body stabilization.

18 Claims, 25 Drawing Sheets

EXERCISE AND TRAINING APPARATUSES AND METHODS OF MAKING AND USING THE SAME

This application claims priority to the U.S. provisional patent application filed under Ser. No. 61/489,759, which is incorporated by reference herein in its entirety.

TECHNICAL FIELD

The present invention relates to apparatuses for increasing strength through exercise and training. Specifically, the present invention relates to apparatuses that increase the difficulty of well-known exercises and weight lifting techniques in order to increase the efficiency of work-outs. More specifically, the present invention relates to apparatuses that promote whole-body stabilization.

BACKGROUND

It is, of course, generally known to increase strength through strength training. Strength training has many forms such as weight training, isometric training, isokinetic training, and resistance training. It is also generally known that progression of a single strength training exercise is called a repetition, or a rep.

Generally, weight training is a method of strength training that uses the force of gravity through weight stacks, plates, dumbbells, bodyweight, or other heavy objects to oppose muscle contraction. The most basic form of weight training is isotonic: lifting a weight through an arc of movement in which the weight does not change. However, a weight typically becomes less difficult to lift as a muscle progresses through the arc of movement because of the change in muscle length. At the beginning of the arc of movement the muscle is weak and begins to contract and increase muscle tension to meet the force of the weight. Once the force of the weight is matched, the muscle tension no longer increases and the weight becomes less difficult to lift throughout the rest of the contraction. This partition of muscle contraction has the least impact on strength training. As the muscle lengthens, however, it becomes weaker again and the weight becomes more difficult to lift. Therefore, the greatest impact on strength training is generally through the first half of muscle contraction.

Universally, isometric training is a method of strength training in which effort is performed against a force in a static position. In isometric training, the muscle output is completely matched by the opposing force so that there is no net movement. Isometric training may be done with resistive forces or gravitation forces in static positions. Isometric training has the ability to specifically target certain muscles based on these certain static positions.

Generally, isokinetic training is a method of strength training that involves variable forces throughout a constant velocity. In order to apply various forces throughout an arc of movement, expensive computing equipment is typically used. As a muscle contracts through an arc of movement, a computer increases the resistance where the muscle is stronger, and decreases the resistance where the muscle is weaker. Pure isokinetic training must be performed under a constant velocity and is generally the fastest and most efficient way to increase strength. However, the use of computers and other like technology is generally impractical and expensive.

In general, resistance training is a method of strength training in which effort is performed against a resisting force. Resistive forces include but are not limited to stretching, compressing, bending, or pushing. Resistance training is different from isotonic weight training in that the resistance continually increases throughout the arc of motion.

It is, of course, generally known to use resistive forces in strength training. Elastic objects can be used to apply these forces. At equilibrium, the forces on an elastic object are balanced. Equilibrium is generally defined, in relation to elastic objects, when an end is given a displacement value of zero ($x=0$). Applying a positive force (F) at equilibrium stretches an elastic object in the positive direction ($x>0$). This creates a force in the negative direction ($-F$) based upon Hooke's law, $F=-k\cdot x$, that attempts to return the elastic object to equilibrium, with k being the elastic object's spring constant. When the positive force (F) is lessened or removed, the negative force ($-F$) is greater than the positive force (F) and the elastic object returns to equilibrium. Generally, the negative force ($-F$) is working against the positive force (F) when moving in the positive direction, while the positive force (F) is working against the negative force ($-F$) when returning to equilibrium. Applying a negative force ($-F$) at equilibrium compresses an elastic object in the negative direction ($x<0$). This creates a force in the positive direction (F) based upon Hooke's law, $F=-k\cdot x$, that attempts to return the elastic object to equilibrium. When the negative force ($-F$) is lessened or removed, the positive force (F) is greater than the negative force ($-F$) and the elastic object returns to equilibrium. Generally, the positive force (F) is working against the negative force ($-F$) when moving in the negative direction, while the negative force ($-F$) is working against the positive force (F) when returning to equilibrium.

Commonly, elastic bands are used in strength training and exercise. Elastic bands, however, only have applications of Hooke's law in the positive direction ($x>0$) and in returning to equilibrium from the positive direction ($x>0$). In order to achieve compression in strength training applications, springs may be used. Springs can store mechanical energy when compressed or stretched, allowing for both applications in strength training and exercise.

In general, the force a spring exerts depends on both its displacement x and its spring constant k. A spring's spring constant k is inherently based on its composition. Different springs may be of the same shape and size, but have different compositions, changing the resistive forces of the spring. Multiple springs of the same size but of different compositions can be analogous to similarly sized weights with different masses.

Generally, by combining resistance training with isotonic weight training, semi-isokinetic training can be accomplished. While pure isokinetic motion cannot occur because the velocity of the arc of movement is not readily held constant, the resistance training may correct some isotonic weight training problems.

A form of weight training is the use of barbells, such as Olympic barbells, having free weights attached thereto. In general, Olympic barbells are uni-functional in that typically, they can only be used to lift a constant weight through a motion. In order for them to obtain multi-functionality, interchangeable weights of different sizes and masses may be added to each end, but typically this is difficult to do during a repetition. When combining resistance training and isotonic weight training, interchangeable parts are typically required in order to create multi-functionality.

Frequently, amateur free weight lifters do not perform strength training properly. Strength training requires proper form and weight in order to avoid injury and to be effective.

Placing a weight bar within a guiding mechanism allows amateur weight lifters to proceed through the proper form safely.

Commonly, when a weight lifter performs a rep, he or she progresses through an arc of movement. Guiding mechanisms may allow for this arc of movement in order for proper reps to occur. The arc of movement may differ from person to person, however, and generally prevents a guiding mechanism from being completely universal. A guiding mechanism to be universally useful, typically must allow a person of any size or shape to customize his or her exercise. Commonly, customizable devices may also have multiple applications in a plurality of exercises.

Generally, a guiding mechanism is stationary allowing for only one particular application of strength training to be performed. Customizing the height, angle, and rotation may allow for multiple applications to be attained by a single guiding mechanism.

In general, hand grips are rough on a lifter's hands because Olympic barbells have grip etchings embedded within. As a lifter progresses through a rep, the lifter's hands rotate while the Olympic barbell remains stationary causing wear to the lifter's palmar skin.

Commonly, Olympic barbells are solid, single objects designed to withhold great amounts of weight secured at each end. These Olympic barbells generally rest on bar holders or are permanently threaded through a guiding mechanism such as in a Smith machine. The stet of the Olympic barbell in a machine restricts use of the Olympic barbell to only applications within said machine. This requires an additional Olympic barbell to be obtained for use in applications outside of said machine.

Regularly, cable and pulley systems are used in strength training to replace barbells are circular weights. Generally, a cable may be attached to a weight and may be pulled through a pulley system. Cable systems maximize utility while minimizing space while allowing for multiple applications with a single system. However, cable and pulley systems are generally isotonic weight training exercises and as a muscle contracts, the weights are typically easier to lift.

Frequently, strength training requires an addition individual in charge of spotting a weight lifter. Weight lifters generally lift heavy weights for long periods of time directly over or near their own bodies. Over time, an individual may become exhausted or fatigued and may no longer be able to lift a weight away from them. These heavy weights, if dropped, can cause serious injury to a weight lifter. A spotter, generally, mildly supports the heavy weight and may actively take complete control of it in case the weight lifter cannot lift the weight any longer.

Occasionally, a weight lifter will lift heavy weights without a spotter. This can be extremely dangerous to the weight lifter. When lifting free weights without a spotter, there is no prevention of injury to the weight lifter if a problem should occur. Some guidance machines, such as the Smith machine, however, can be used without a spotter because of a built-in spotting mechanism. Built-in spotting mechanisms provide a safety measure when an additional individual is unavailable.

Generally, exercises are performed that focus on a single muscle group. Commonly, stabilizing muscles are ignored in order to increase focus on that single muscle group, thus increasing the size and strength of that single muscle group. Exercising stabilizing muscles along with specific muscle groups is generally unfamiliar and difficult to beginners or novice weight lifters.

A need, therefore, exists for an apparatus that can combine resistance training and isotonic weight training in order to achieve benefits most closely similar to isokinetic training.

Moreover, a need exists for an apparatus that uses spring compression resistance in combination with isotonic weight training.

Further, a need exists for an apparatus with interchangeable weights and interchangeable springs for multiple resistances.

Additionally, a need exists for an apparatus with a guiding mechanism that supports weight lifters in performing lifts safely and correctly.

Moreover, a need exists for a guiding mechanism that allows a person of any size or shape to customize his or her exercise to fit his or her needs.

Furthermore, a need exists for an adjustable guiding mechanism in height and angle that may also rotate in order for multiple applications to be accomplished.

Also, a need exists for a customizable apparatus that may be locked into place for specific applications.

Moreover, a need exists for an apparatus with hand grips that rotate with a lifter's hands reducing the wear to the palmar skin.

Additionally, a need exists for a bar apparatus that can be separated thereby allowing the apparatus to be inserted into and removed from otherwise permanent fixtures.

Similarly, a need exists for a bar apparatus that can be separated thereby allowing customizable components to be added thereon.

Further, a need exists for an apparatus that contains a cable and pulley system for additional beneficial strength training exercises.

Moreover, a need exists for an apparatus with built-in spotting mechanisms that can prevent injury to the weight lifter.

Finally, a need exist for an apparatus that easily supports stabilizing muscles along with specific muscle groups for beginners or novice weight lifters.

SUMMARY OF THE INVENTION

The present invention relates to apparatuses for increasing strength through exercise and training. Specifically, the present invention relates to apparatuses that increase the difficulty of well-known exercises and weight lifting techniques in order to increase the efficiency of work-outs. More specifically, the present invention relates to apparatuses that promote whole-body stabilization.

To this end, in an embodiment of the present invention, weight training equipment is provided. The equipment comprises at least one compression spring that is engaged during a repetition, adding compression resistance to isotonic weight training and at least one compression mechanism to contact and engage a compression spring.

It is, therefore, an advantage of the present invention to provide an apparatus that can combine resistance training and isotonic weight training in order to achieve benefits most closely similar to isokinetic training.

Moreover, it is an advantage of the present invention to provide an apparatus that uses spring compression resistance in combination with isotonic weight training.

Further, it is an advantage of the present invention to provide an apparatus with interchangeable weights and interchangeable springs for multiple resistances.

Additionally, it is an advantage of the present invention to provide an apparatus with a guiding mechanism that supports weight lifters in performing lifts safely and correctly.

Moreover, it is an advantage of the present invention to provide a guiding mechanism that allows a person of any size or shape to customize his or her exercise to fit his or her needs.

Furthermore, it is an advantage of the present invention to provide an adjustable guiding mechanism in height and angle that may also rotate in order for multiple applications to be accomplished.

Also, it is an advantage of the present invention to provide a customizable apparatus that may be locked into place for specific applications.

Moreover, it is an advantage of the present invention to provide an apparatus with hand grips that rotate with a lifter's hands reducing the wear to the palmar skin.

Additionally, it is an advantage of the present invention to provide a bar apparatus that can be separated thereby allowing the apparatus to be inserted into and removed from otherwise permanent fixtures.

Similarly, it is an advantage of the present invention to provide a bar apparatus that can be separated thereby allowing customizable components to be added thereon.

Further, it is an advantage of the present invention to provide an apparatus that contains a cable and pulley system for additional beneficial strength training exercises.

Moreover, it is an advantage of the present invention to provide an apparatus with built-in spotting mechanisms that can prevent injury to the weight lifter.

Finally, it is an advantage of the present invention to provide an apparatus that easily supports stabilizing muscles along with specific muscle groups for beginners or novice weight lifters.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present embodiments, by way of example only, not by way of limitations. In the figures, like reference numerals refer to the same or similar elements.

DETAILED DESCRIPTION OF THE PRESENTLY PREFERRED EMBODIMENTS

The present invention relates to apparatuses for increasing strength through exercise and training. Specifically, the present invention relates to apparatuses that increase the difficulty of well-known exercises and weight lifting techniques in order to increase the efficiency of work-outs. More specifically, the present invention relates to apparatuses that promote whole-body stabilization.

Although the present invention is described in relation increasing the difficulty of weight training, it should be apparent to one of ordinary skill in the art that the components of the present invention, as described in the embodiments presented herein, may be useful for other training exercises.

Figure 1:
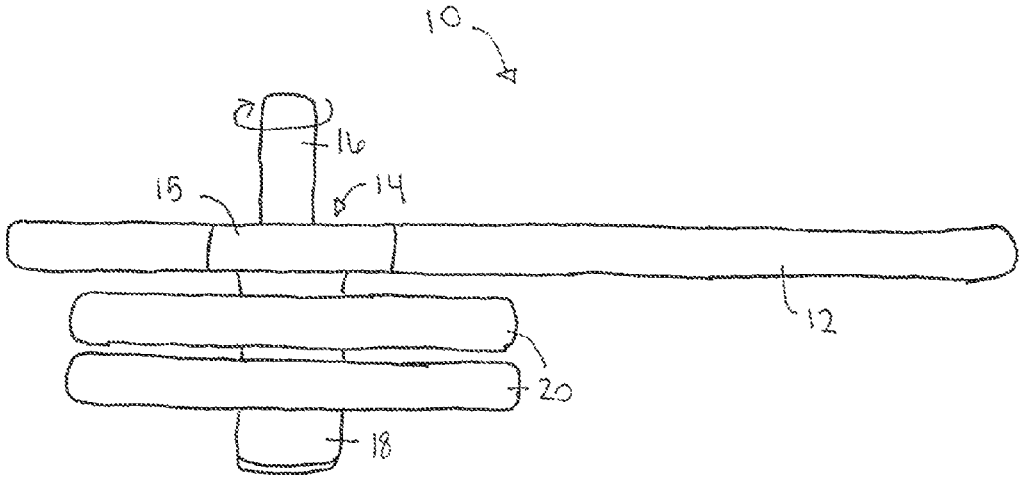
FIG. 1 illustrates a top-down view of an embodiment of the present invention for use with isotonic training.

Now referring to the figures, wherein like numerals refer to like parts, an embodiment is provided in FIG. 1. An apparatus 10 may be comprised of a core bar 12 and a mounting device 14. The mounting device 14 may be disposed at one end of core bar 12 secured around core bar 12. For example, mounting device 14 may include a sleeve portion 15 that may be disposed around core bar 12 allowing the sleeve portion 15 to slide along core bar 12. The mounting device 14 may be comprised of a hand grip 16 and a weight plate mount 18 and may advance parallel along core bar 12. The hand grip 16 may rotate freely, as indicated in FIG. 1, to prevent wear to weight lifters palmar skin during progression of mounting device 14 along core bar 12. Weight plates 20 may be added to weight plate mount 18 for additional isotonic weight resistance.

Figure 2:
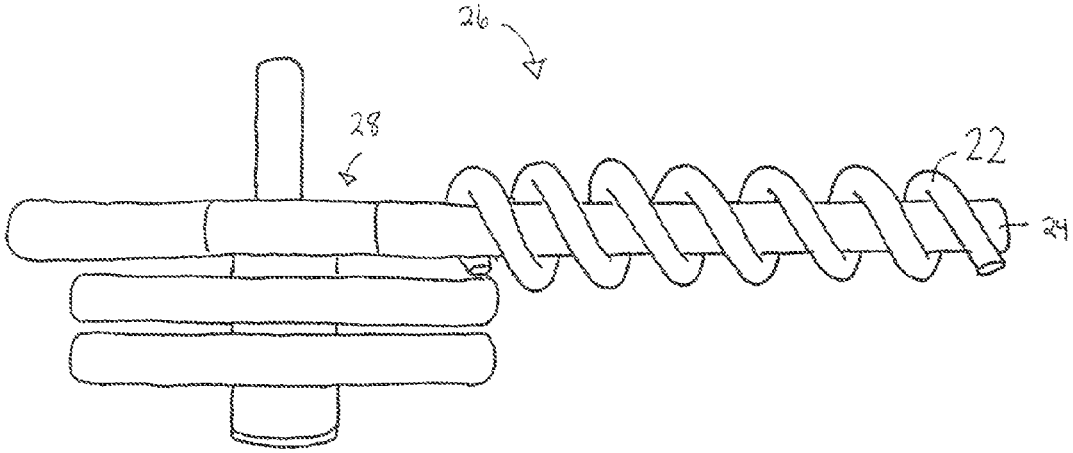
FIG. 2 illustrates a top-down view of an embodiment of the present invention for use with isotonic and resistance training.

As shown in FIG. 2, an alternate embodiment is shown and described. An apparatus 26 may include a compression spring 22. The compression spring 22 may be disposed at and around one end of a core bar 24 opposite of a mounting device 28. The mounting device 28 may advance parallel along core bar 24, engaging the compression spring 22 until compression spring 22 is completely compressed, thereby increasing resistance. The mounting device 28 may regress parallel along core bar 24 disengaging the compression spring 22 and return to disposed position at end of core bar 24. Thus, a repetition by a user, moving mounting device 28 along core bar 24 and engaging compression spring 22 may preferably cause an increase in resistance through the movement of mounting device 28 during contraction of the muscles and a decrease in resistance through the movement of the mounting device during the release portion of the repetition. Apparatus 26 may be lifted isotonically, and the compression spring 22 may add resistance to the repetition during the second half of muscle contraction, making the second half of muscle contraction as effective as the first half of muscle contraction. Therefore, apparatus 26 allows for an entire repetition of muscle contraction to be the greatest impact on strength training rather than the first half of muscle contraction.

Figure 3:
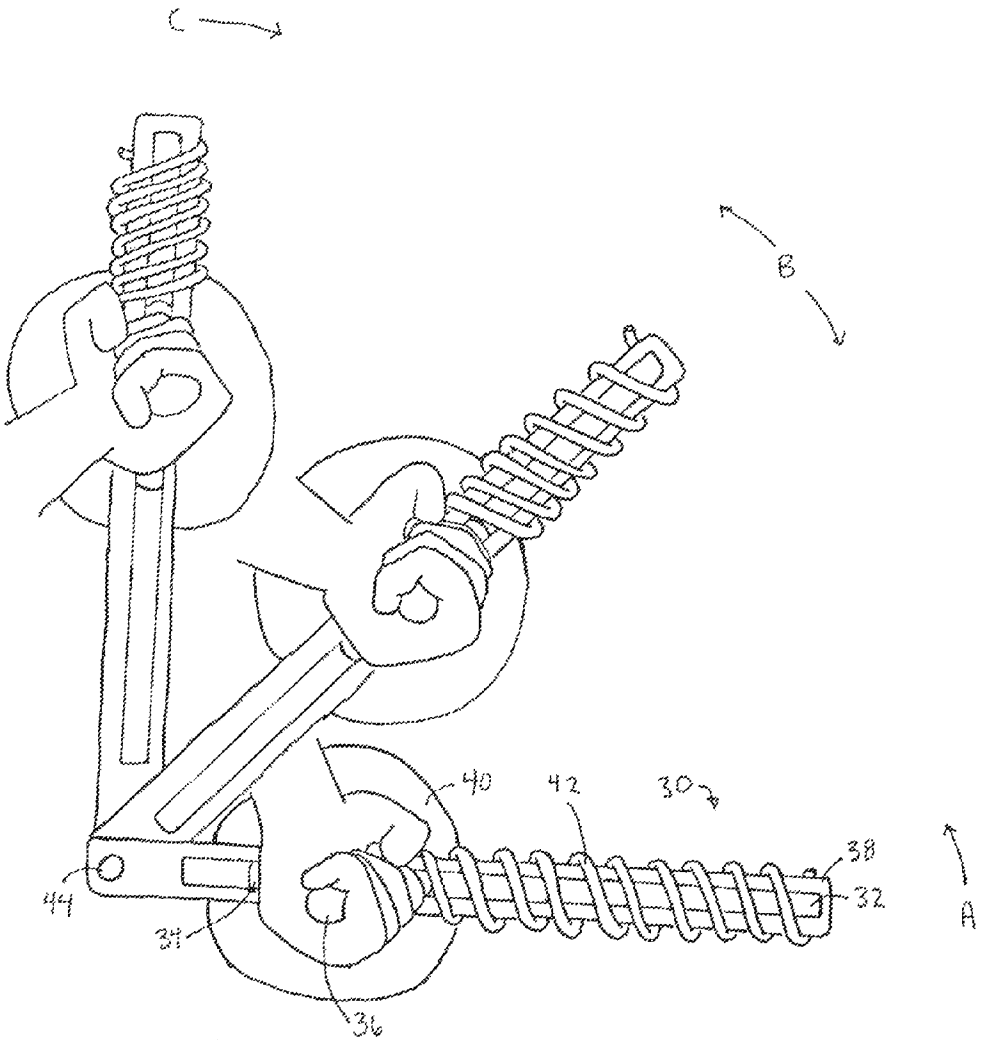
FIG. 3 illustrates a side view of an alternate embodiment of the present invention passing through a single rep.

As shown in FIG. 3, an alternate embodiment is shown and described as it may progress from a point A, through a point B, to a point C. An apparatus 30 may be comprised of a core bar 32 disposed internally in an enclosure 38. A mounting device 34 may be disposed internally in enclosure 38 secured around and at one end of core bar 32 and slidable within the enclosure 38. The mounting device 34 may be comprised of a hand grip 36 and a weight plate mount (not shown) and may advance or regress parallel along core bar 32. The hand grip 36 and weight plate mount (not shown) may extend outwards of enclosure 38 so as to be accessible to the weight lifter. Weight plates 40 may be added to weight plate mount (not shown) for additional isotonic weight resistance. A compression spring 42 may be disposed at and around one end of enclosure 38 opposite of hand grip 36. The mounting device 34 may advance down core bar 32 engaging compression spring 42 until compression spring 42 is completely compressed, thereby increasing resistance during contraction of the muscle through the repetition. The mounting device 34 may regress parallel along core bar 32 disengaging the compression spring 42 and returning to its starting position at end of core bar 32. The apparatus 30 may rotate along a pivot 44 whilst progressing from point A to point C. The apparatus 30 at point A may comprise of compression spring 42 at equilibrium. As apparatus 30 progresses to a mid-point B mounting device 34 may advance and partially compress compression spring 42, adding additional resistance to the isotonic weight training obtained using weight plates 40. The apparatus 30 at point C may comprise of compression spring 42 fully compressed. The hand grip 36 may rotate freely to prevent wear to palmar skin of weight lifter during progression of mounting device 34 during a rep.

Figure 4:
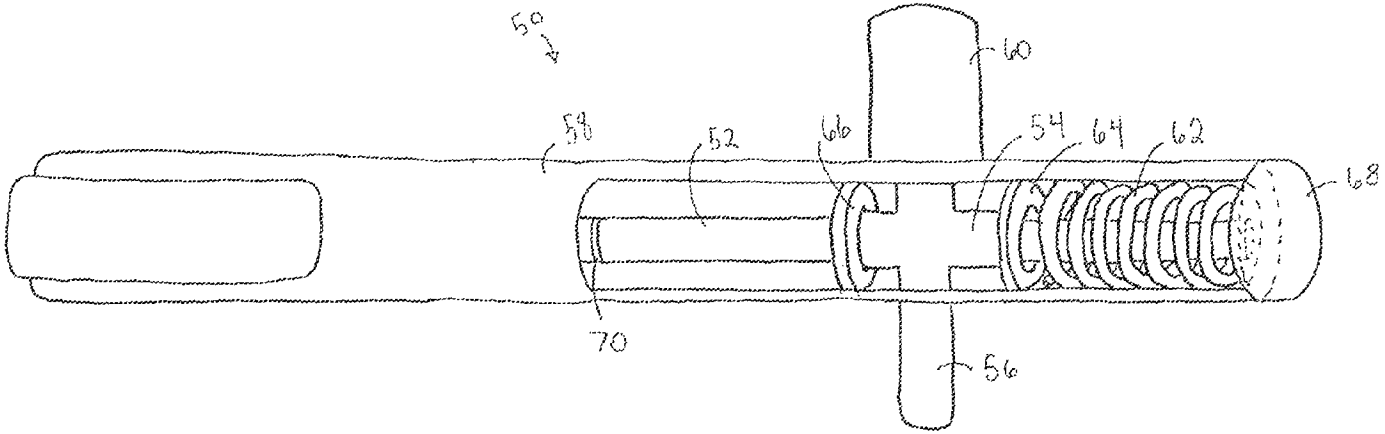
FIG. 4 illustrates a top-down view of an alternate embodiment of the present invention enclosed in a shell.

As shown in FIG. 4, an alternate embodiment is shown and described. An apparatus 50 may be comprised of a core bar 52 disposed internally in an enclosure 58. A mounting device 54 may be disposed internally in enclosure 38 and externally around core bar 52. The mounting device 54 may advance and regress parallel along core bar 52. The mounting device 54 may be comprised of a hand grip 56, a weight plate mount 60, a spring end plate 64, and a halting plate 66. The hand grip 56 and weight plate mount 60 may extend outwards of enclosure 58 so as to be accessible to the weight lifter. The hand grip 56 may rotate freely in order to prevent wear to palmar skin of weight lifter during a rep. A compression spring 62 may be disposed internally in enclosure 58 and around core bar 52 at one end opposite mounting device 54. Mounting device 54 may advance internally in enclosure 58 engaging compression spring 62 with spring end plate 64 until compression spring 62 is fully compressed, thereby increasing resistance. An exterior cap 68 may be secured to enclosure 58 and used to brace compression spring 62 at one end opposite spring plate 64. Exterior cap 68 may be removable in order to interchange compression spring 62 with an alternate compression spring (not shown) having a different resistance. Mounting device 54 may regress internally in enclosure 58 disengaging compression spring 62 and concluding when halting plate 66 comes into contact with stopper 70. Weight plates (not shown) may be added to weight plate mount 60 for addition isotonic weight resistance.

Figure 5:
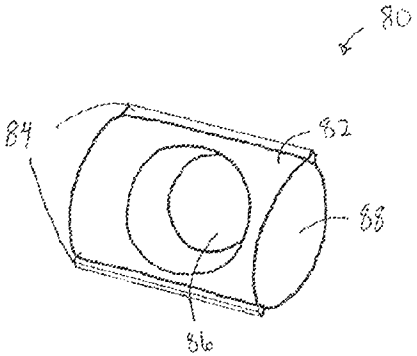
FIG. 5 illustrates a perspective view of an interior compression mechanism for use in an embodiment of the present invention.

As shown in FIG. 5, an alternate mounting device 80 is shown and described. Mounting device 80 may be comprised of a cylindrical shell 82, guiding fins 84, a cylindrical hole 86, and a spring plate 88. The cylindrical shell 82 may be made from solid metal or an otherwise strong and sturdy material known to one skilled in the art that will allow a cylindrical hole 86 to be drilled. Guiding fins 84 may be used to correctly line-up mounting device 80 and cylindrical hole 86 for accepting a core bar (not shown). The spring plate 88 may be used to engage a compression spring (not shown) when mounting device 80 is advanced toward the compression spring (not shown).

Figure 6:
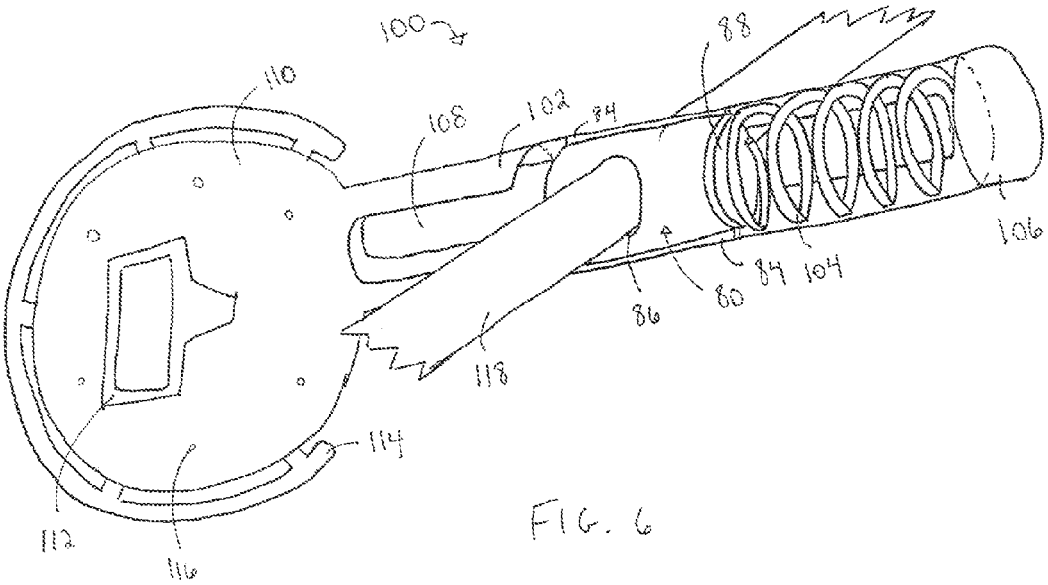
FIG. 6 illustrates a perspective view of an interior compression mechanism in use in an embodiment of the present invention.

As shown in FIG. 6, an alternate embodiment is shown and described. An apparatus 100 may be comprised of a hollow enclosure 102, a mounting device 80, a compression spring 104, an exterior cap 106, a core bar sleeve 108, and an attaching surface 110. Exterior cap 106 may be secured to one end of hollow enclosure 102. Attaching surface 110 may be secured to an opposite end of hollow enclosure 102 and may comprise of a pull-release handle 112, a handgrip 114, and locking holes 116. The pull-release handle 112 may be used to securely lock apparatus 100 to a vertical column on a weight bench (not shown) through attaching surface 110. The pull-release handle 112 may be made out of highly resilient metal or another strong material known to one in the art that can withstand the heavy loads involved in strength training. The handgrip 114 may be used to rotate apparatus 100 into different angled positions. The locking holes 116 may be used to securely lock apparatus 100 into a specific angled position using locking pins (not shown).

The mounting device 80 may be disposed internally in hollow enclosure 102 lined-up by guiding fins 84. A core bar 118 may pass through hollow enclosure 102 by means of core bar sleeve 108. The core bar 118 may pass through mounting device 80 by means of cylindrical hole 86. The mounting device 80 may advance or regress inside of hollow enclosure 102 when external force is applied to core bar 118, such as when core bar 118 is passed through mounting device 80. The core bar 118 may advance or regress externally around core bar sleeve 108. Core bar 118 and mounting device 80 may engage compression spring 104 with spring plate 88 when core bar 118 advances toward exterior cap 106 until compression spring 104 is completely compressed, thereby increasing resistance. Core bar 118 and mounting device 80 may disengage compression spring 104 when core bar 118 regresses away from exterior cap 106, terminating at end of core bar sleeve 108 opposite exterior cap 106. Exterior cap 106 may be removable in order to interchange compression spring 104 with an alternate compression spring (not shown) having a different resistance.

Figure 7:
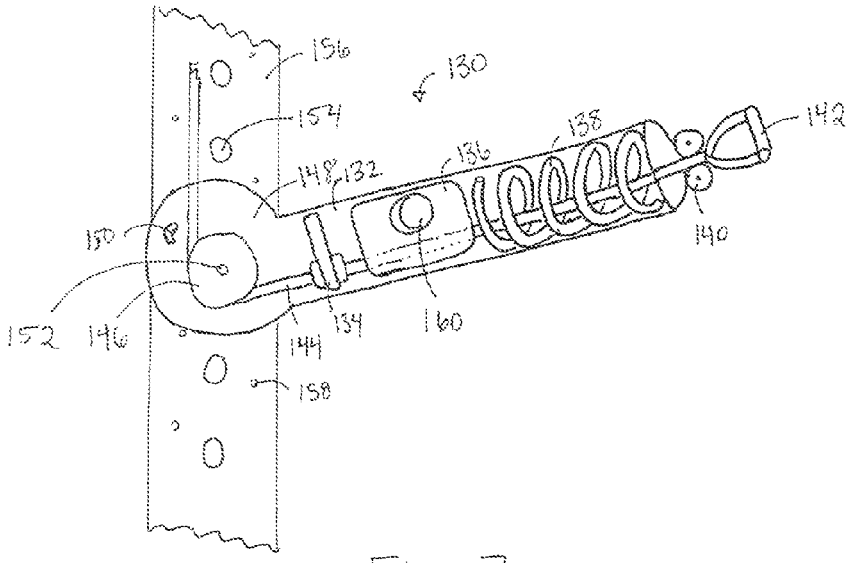
FIG. 7 illustrates a side view of an alternate embodiment of the present invention with a cable and pulley system.

As shown in FIG. 7, an alternate embodiment is shown and described. An apparatus 130 may comprise a hollow enclosure 132, a compression mechanism 134, a mounting device 136, a compression spring 138, a rotating pulley system 140, a cable handle 142, a cable 144, an interior pulley 146, an attaching surface 148, and locking pins 150. Attaching surface 148 may be disposed at one end of hollow enclosure 132 and rotating pulley system 140 may be disposed externally at an opposite end of hollow enclosure 132. Rotating pulley system 140 may allow cable 144 to pass through controllably while allowing 360 degrees of rotation of cable 144 and rotating pulley system 140. Cable 144 may be attached to a weight stack (not shown) at one end. Cable 144 may be disposed internally through apparatus 130 at the opposite end, entering vertically into attaching surface 148, arcing around interior pulley 146, and extending outwards through hollow enclosure 132 towards rotating pulley system 140. The compression mechanism 134 may be disposed internally in one end of hollow enclosure 132 and may be secured directly to cable 144 so the two may move conjunctively. Cable 144 may pass through mounting device 136 and compression spring 138 so as to move independently of mounting device 136 and compression spring 138. Cable 144 may end in cable handle 142 disposed externally and beyond rotating pulley system 140 and hollow enclosure 132. Cable handle 142 may be used to pull cable 144 outwards through rotating pulley system 140, rotate interior pulley 146, lift weight stack (not shown) isotonically, advance compression mechanism 134 towards mounting device 136, contact mounting device 136 with compression mechanism 134, advance mounting device 136 towards compression spring 138, and engage compression spring 138 with mounting device 136 until compression spring 138 is fully compressed, thereby increasing resistance. Interior pulley 146 may comprise an opening 152 so as to allow a pull-release handle (not shown) to be inserted through and into a height slot 154 to secure apparatus 130 to a vertical column 156 at a specified height. Apparatus 130 may rotate along opening 152 using pull-release handle (not-shown) as a pivot. Locking pins 150 may be used to secure apparatus 130 at a specific angled position through a locking hole 158 in vertical column 156. Mounting device 136 and hollow enclosure 132 may allow a core bar (not shown) to pass through cylindrical hole 160. Mounting device 136 may advance independently of cable 144 and contact compression spring 138 when external force is applied to the core bar (not shown). Isotonic weight training may be completed by use of the core bar (not shown) independently of cable 144 and weight stack (not shown). Mounting device 136 may advance towards rotating pulley system 140, engaging compression spring 138 until compression spring 138 is fully compressed thereby increasing resistance. Mounting device 136 may regress away from rotating pulley system 140, disengaging compression spring 138 and returning to the starting position.

Figure 8:
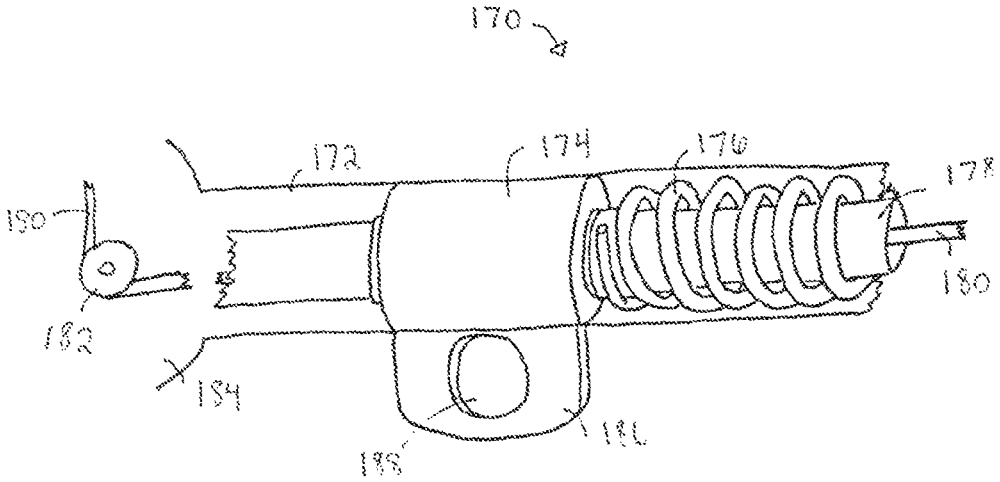
FIG. 8 illustrates a perspective view of an exterior compression mechanism in use in an alternate embodiment the present invention.

As shown in FIG. 8, an embodiment is shown and described. An arm apparatus 170 may comprise a hollow enclosure 172, a mounting device 174, a compression spring 176, a hollow core bar 178, a cable 180, an interior pulley 182, and an attaching surface 184. The mounting device 174 may be disposed internally within hollow enclosure 172 at one end and around hollow core bar 178. The mounting device 174 may comprise an external mount 186 extending outwardly from hollow enclosure 172. The external mount 186 may comprise a cylindrical hole 188 in which a core bar (not shown) may be placed therethrough. The compression spring 176 may be disposed internally within hollow enclosure 172 at the opposite end of the mounting device 174 and around hollow core bar 178. The cable 180 may be disposed internally within hollow core bar 178 and extend the length of arm apparatus 170. The attaching surface 184 may be secured to the hollow enclosure 172 at one end of arm apparatus 170. The interior pulley 182 may be disposed internally within attaching surface 184 and may make contact with cable 180 in order to change direction of cable 180. The mounting device 174 may advance parallel along hollow core bar 178 toward compression spring 176 when force is applied to a core bar (not shown) threaded through cylindrical hole 188. The mounting device 174 may engage compression spring 176 until fully compressed, thereby increasing resistance. The mounting device 174 may disengage compression spring 176 and return to the starting position.

Figure 9:
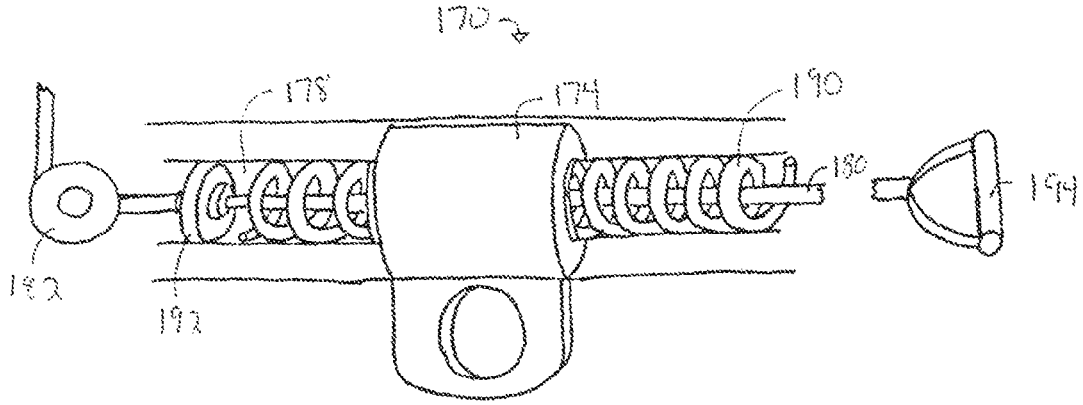
FIG. 9 illustrates a perspective hollow view of an exterior compression mechanism in use in an alternate embodiment the present invention.

As shown in FIG. 9, a partially hollow view of the previous embodiment is shown and described. The arm apparatus 170 may additionally comprise an interior compression spring 190, a compression mechanism 192, and a cable handle 194. The interior compression spring 190 may be disposed internally within hollow core bar 178. The compression mechanism 192 may be disposed internally within and at one end of hollow core bar 178. Cable 180 may be disposed internally within hollow core bar 178 and pass through interior compression spring 190 so that the two move independently. Cable 180 may be secured to compression mechanism 192 so that the two move dependently. Cable handle 194 may be secured to cable 180 and disposed at one end opposite the compression mechanism 192. Cable handle 194 may be used to pull cable 180 outwards, rotate interior pulley 182, lift weight stack (not shown) isotonically, advance compression mechanism 192 towards interior compression spring 190, and engage interior compression spring 190 with compression mechanism 192 until interior compression spring 190 is fully compressed, thereby increasing resistance throughout the repetition, and throughout the contraction of the specific muscle or muscle group of the user. Compression mechanism 192 and interior compression spring 190 may be engaged independently of mounting device 174.

Figure 10:
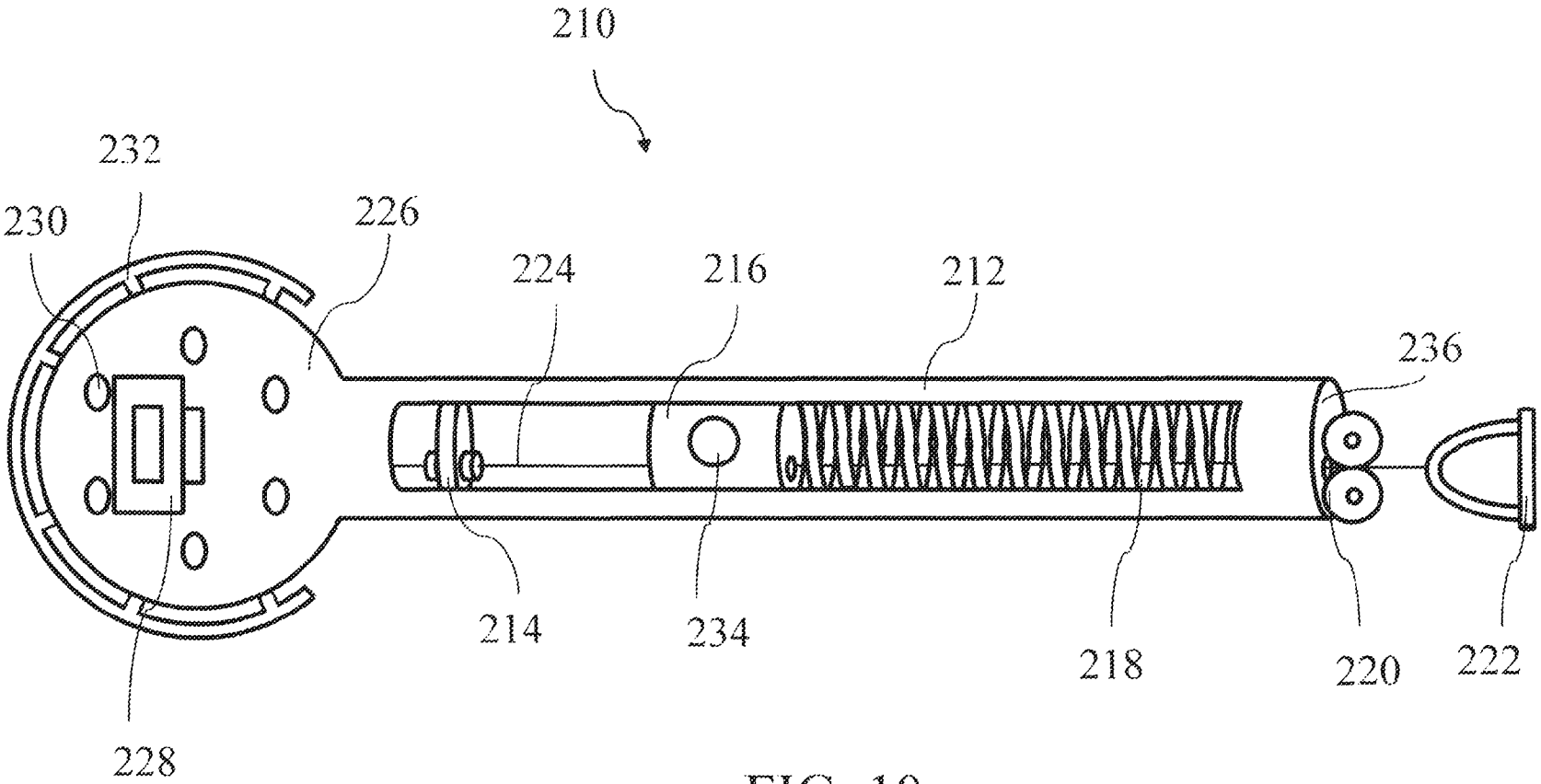
FIG. 10 illustrates a perspective view of an embodiment of the present invention.

As shown in FIG. 10, an embodiment is shown and described. An apparatus 210 may comprise a hollow enclosure 212, a compression mechanism 214, a mounting device 216, a compression spring 218, a rotating pulley system 220, a cable handle 222, a cable 224, and an attaching surface 226. Attaching surface 226 may be secured at one end of hollow enclosure 212 and rotating pulley system 220 may be disposed externally at the opposite end of hollow enclosure 212. Rotating pulley system 220 may allow cable 224 to pass through controllably while allowing 360 degrees of rotation of cable 224 and rotating pulley system 220. Cable 224 may be attached to a weight stack (not shown) at one end. Cable 224 may be disposed internally through the length of apparatus 210, entering vertically into attaching surface 226 and extending outwards through hollow enclosure 212 towards rotating pulley system 220. The compression mechanism 214 may be disposed internally in one end of hollow enclosure 212 and may be secured directly to cable 224 so the two may move conjunctively. Cable 224 may pass through mounting device 216 and compression spring 218 so as to move independently of mounting device 216 and compression spring 218. Cable 224 may terminate in cable handle 222 disposed externally and beyond rotating pulley system 220 and hollow enclosure 212. Cable handle 222 may be used to pull cable 224 outwards through rotating pulley system 220, rotate interior pulley (not shown), lift weight stack (not shown) isotonically, advance compression mechanism 214 towards mounting device 216, contact mounting device 216 with compression mechanism 214, advance mounting device 216 towards compression spring 218, and engage compression spring 218 with mounting device 216 until compression spring 218 is fully compressed, thereby increasing resistance. Attaching surface 226 may comprise a pull-release handle 228 to be inserted through and into a height slot (not shown) to secure apparatus 210 to a vertical column (not shown) at a specified height. Apparatus 210 may rotate using pull-release handle 228 as a pivot. Attaching surface 226 may comprise locking holes 230 that may be used to secure apparatus 210 at a specific angled position in vertical column (not shown) by use of locking pins (not shown). Attaching surface 226 may further comprise a hand grip 232. Hand grip 232 may be used to maneuver apparatus 210 to a specific height or angled position. Mounting device 216 and hollow enclosure 212 may allow a weight bar (not shown) to pass through cylindrical hole 234. Mounting device 216 may advance independently of cable 224 and contact compression spring 218 when external force is applied to the weight bar (not shown). Isotonic weight training may be completed by use of the weight bar (not shown) independently of cable 224 and weight stack (not shown). Mounting device 216 may advance towards rotating pulley system 220, engaging compression spring 218 until compression spring 218 is fully compressed, thereby increasing resistance throughout the repetition during contraction of the muscle of muscles of the user. Compression spring 218 may be compressed between mounting device 216 and an exterior cap 236. Exterior cap 236 provides a barrier for compression spring 218 to be compressed against. Mounting device 216 may regress away from exterior cap 236, disengaging compression spring 218 and returning to the starting position.

Figure 11:
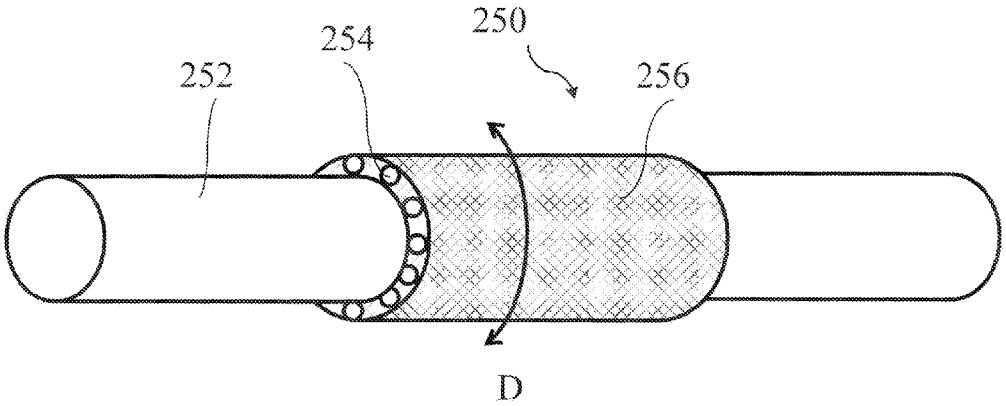
FIG. 11 illustrates a perspective view of a rotating hand grip in an alternate embodiment of the present invention.

As seen in FIG. 11, in an alternate embodiment of the present invention, a rotating hand grip for a weight bar is shown and described. An apparatus 250 may comprise a core bar 252 that may be used in weight training. Hand grip 256 may be made of metal or otherwise strong material known to one having ordinary skill in the art with etchings to allow a weight trainer to more easily grasp hand grip 256. A plurality of ball bearings 254 may be disposed within hand grip 256 to allow hand grip 256 to rotate freely along a path D. Path D may be a 360 degree rotation. As a weight trainer lifts apparatus 250, core bar 252 may remain stationary, while hand grip 256 may rotate with weight trainer's arc of motion reducing wear to weight trainer's palmar skin.

Figure 12:
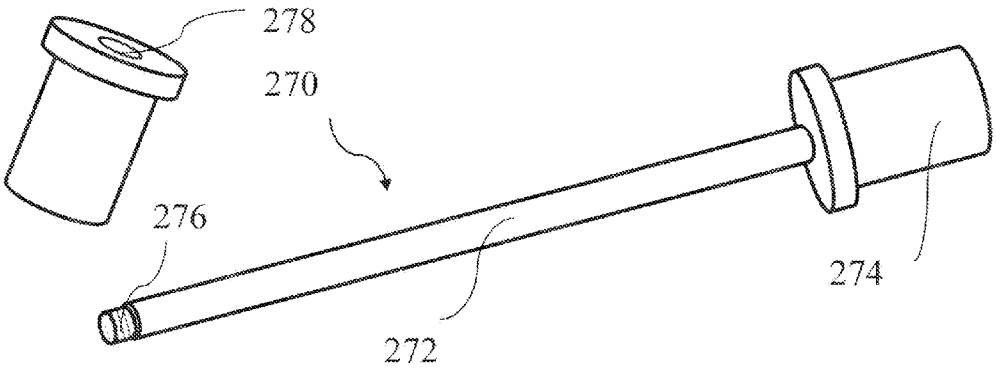
FIG. 12 illustrates a perspective view of a weight bar separable at the ends in an alternate embodiment of the present invention.

As seen in FIG. 12, an alternate embodiment of a weight bar is shown and described. An apparatus 270 may comprise a core bar 272, a plurality of weight mounts 274, a threaded donor 276, and a threaded acceptor 278. One of both of the weight mounts 274 may be removed from core bar 272 by loosening threaded donor 276 from threaded acceptor 278 similar to loosening a screw from a nut in a counterclockwise motion. This may allow for apparatus 270 to be inserted into fixtures or machines that a typical weight bar could not. After apparatus 270 is inserted into a fixture or machine, weight mount 274 may be rejoined to core bar 272 by tightening weight mount 274 with threaded acceptor 278 to core bar 272 with threaded donor 276 in a clockwise motion.

Figure 13:
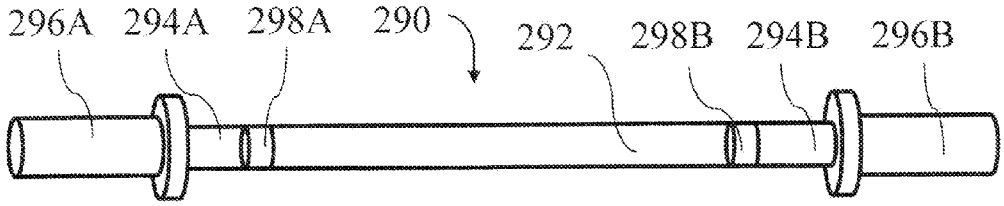
FIG. 13 illustrates a perspective view of a weight bar separable in the middle in an alternate embodiment of the present invention.

As shown in FIG. 13, an alternate embodiment of a weight bar is shown and described. An apparatus 290 may comprise a core bar 292, a left-hand grip 294A, a right-hand grip 294B, a left-hand weight mount 296A, a right-hand weight mount 296B, a left-hand connector 298A, and a right-hand connector 298B. Left-hand grip 294A and left-hand weight mount 296A may be secured together so as to form one sturdy piece. Right-hand grip 294B and right-hand weight mount 296B may be secured together so as to form one sturdy piece. The core bar 292 may be secured to left-hand grip 294A with left-hand connector 298A at one end. The core bar 292 may be secured to right-hand grip 294B with right-hand connector 298B at one end. The core bar 292 may be removable to use left-hand grip 294A and right-hand grip 294B independently.

Figure 14:
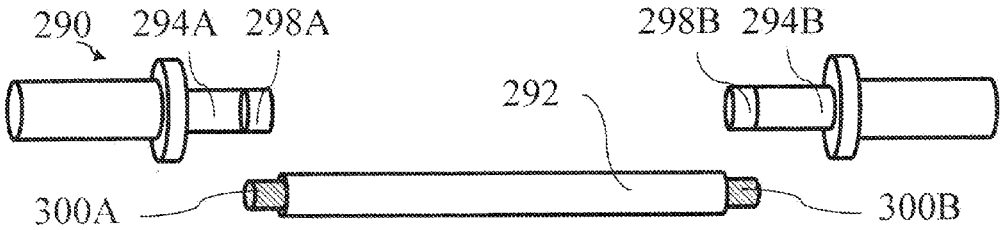
FIG. 14 illustrates a perspective view of a weight bar separated in the middle.

As shown in FIG. 14, apparatus 290 is shown with core bar 292 removed. The core bar 292 may comprise a left-hand threaded donor 300A that may be inserted into left-hand connector 298A and a right-hand threaded donor 300B that may be inserted into right-hand connector 298B. Core bar 292 may be inserted into left-hand grip 294A via left-hand connector 298A and rotated clockwise to secure. Core bar 292 may be inserted into right-hand grip 294B via right-hand connector 298B and rotated clockwise to secure.

Figure 15:
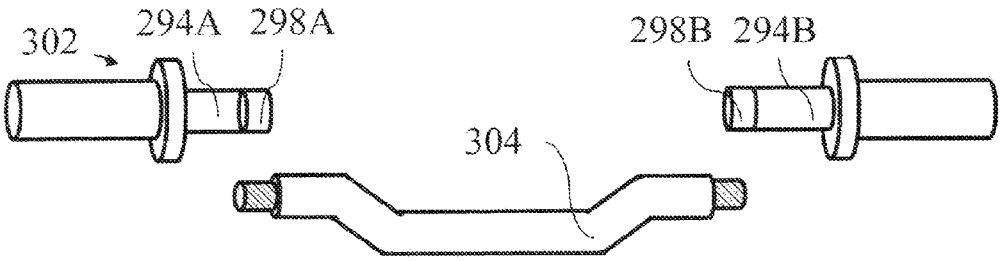
FIG. 15 illustrates a perspective view of a weight bar separated in the middle with an alternate middle section.

As shown in FIG. 15, an alternate embodiment is shown and described. An apparatus 302 may comprise an alternate core bar section 304. Alternative core bar section 304 may be inserted into right-hand grip 294B via right-hand connector 298B and rotated clockwise to secure. Alternative core bar section 304 may be inserted into left-hand grip 294A via left-hand connector 298A and rotated clockwise to secure. Alternative core bar section 304 may provide addition workouts without additional weight bars.

Figure 16:
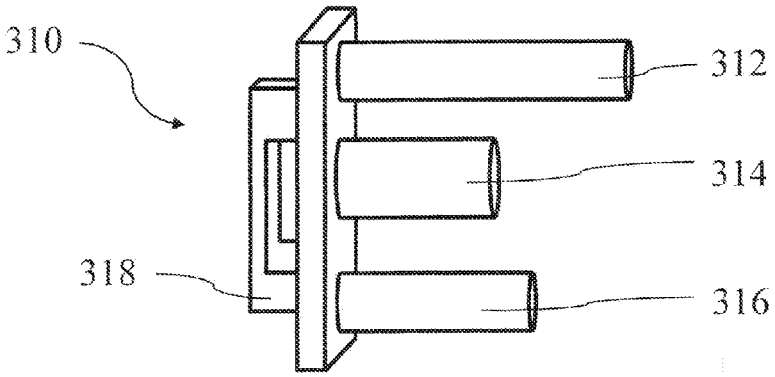
FIG. 16 illustrates a perspective view of a spotter chock in an alternate embodiment of the present invention.

As shown in FIG. 16, a supplementary embodiment of a spotter chock is shown and described. An apparatus 310 may comprise a chock 312, an insert peg 314, a counter peg 316, and a handle 318. The chock 312 may be used to prevent motion of exterior force while the counter peg 316 may be used to prevent motion of apparatus 310. The counter peg 316 may also be used to absorb and dissipate energy from force prevented by chock 312. Handle 318 may be used to remove and insert apparatus 310 into a vertical column (not shown) via the insert peg 314.

Figure 17:
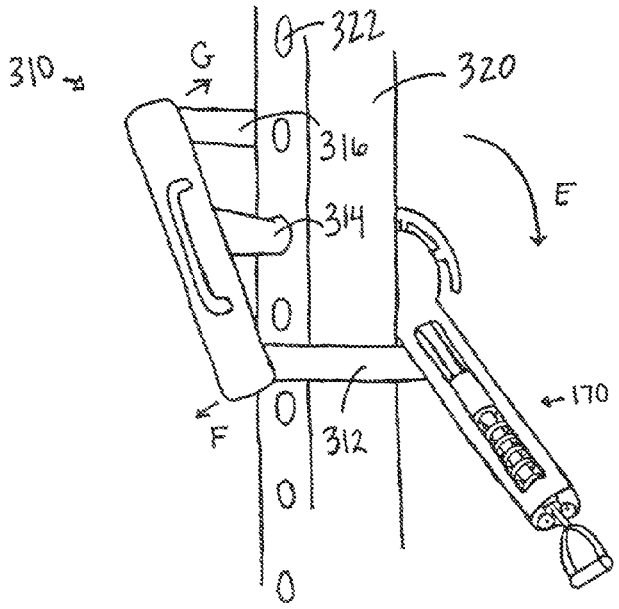
FIG. 17 illustrates a perspective view of a spotter chock in use with an embodiment of the present invention.

As shown in FIG. 17, an alternate embodiment is shown and described. Apparatus 310 may be used together with arm apparatus 170 in an alternate embodiment of the present invention. As arm apparatus 170 rotates along path E, the chock 312 may halt rotation when apparatus 310 is inserted into vertical column 320. Insert peg 314 may be placed inside of a height slot 322 in order to secure apparatus 310 to vertical column 320. When arm apparatus 170 makes contact with chock 312, a force F may be exerted down and towards vertical column 320. This force F may travel through apparatus 310 and create a counter-force G that may be exerted up and towards the vertical column 320 by counter peg 316. Force F and force G resist each other and create a lesser, more manageable force.

Figure 18:
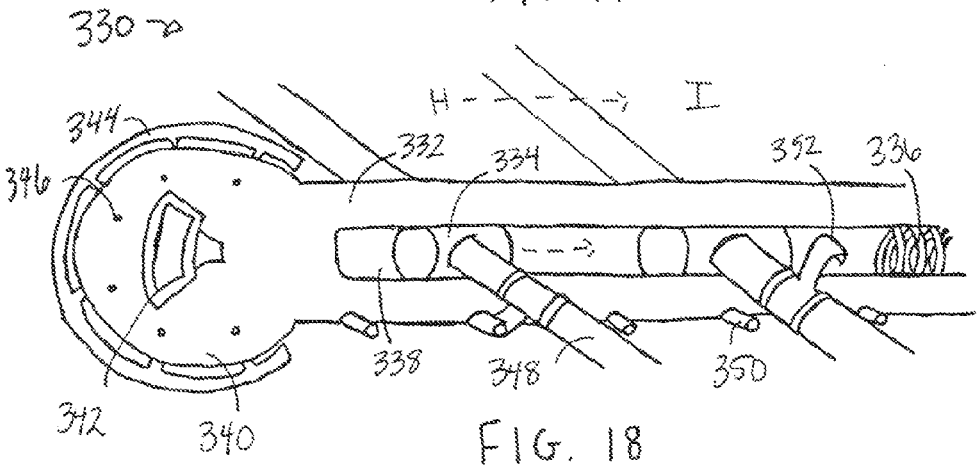
FIG. 18 illustrates a perspective view of an alternate spotting hook in use with an embodiment of the present invention.

As shown in FIG. 18, an alternate embodiment is shown and described. An apparatus 330 may comprise a hollow enclosure 332, a mounting device 334, a compression spring 336, a weight bar sleeve 338, and an attaching surface 340. Attaching surface 340 may be secured to an opposite end of hollow enclosure 332 and may comprise a pull-release handle 342, a handgrip 344, and locking holes 346. The pull-release handle 342 may be used to securely lock apparatus 330 to a vertical column on a weight bench (not shown) or other weight lifting machine through attaching surface 340. The pull-release handle 342 may be made out of highly resilient metal or another strong material known to one in the art that can withstand the heavy loads involved in strength training. The handgrip 344 may be used to rotate apparatus 330 into different angled positions. The locking holes 346 may be used to securely lock apparatus 330 into a specific angled position using locking pins (not shown). The mounting device 334 may be disposed internally in hollow enclosure 332. The mounting device 334 may advance or regress inside of hollow enclosure 332 when external force is applied to weight bar 348 when weight bar 348 is passed through mounting device 334. The weight bar 348 may advance or regress externally through weight bar sleeve 338. Hollow enclosure 332 may comprise a plurality of catch pegs 350 along the length of hollow enclosure 332. Weight bar 348 may comprise a catch hook 352 able to latch to catch pegs 350 as shown by point H. A weight bar 348 in position H will prevent compression spring 336 from regressing the mounting device 334 and weight bar 348 unintentionally. Weight bar 348 may rotate, releasing catch hook 352 from catch peg 350 and advance toward point I independently.

Figure 19:
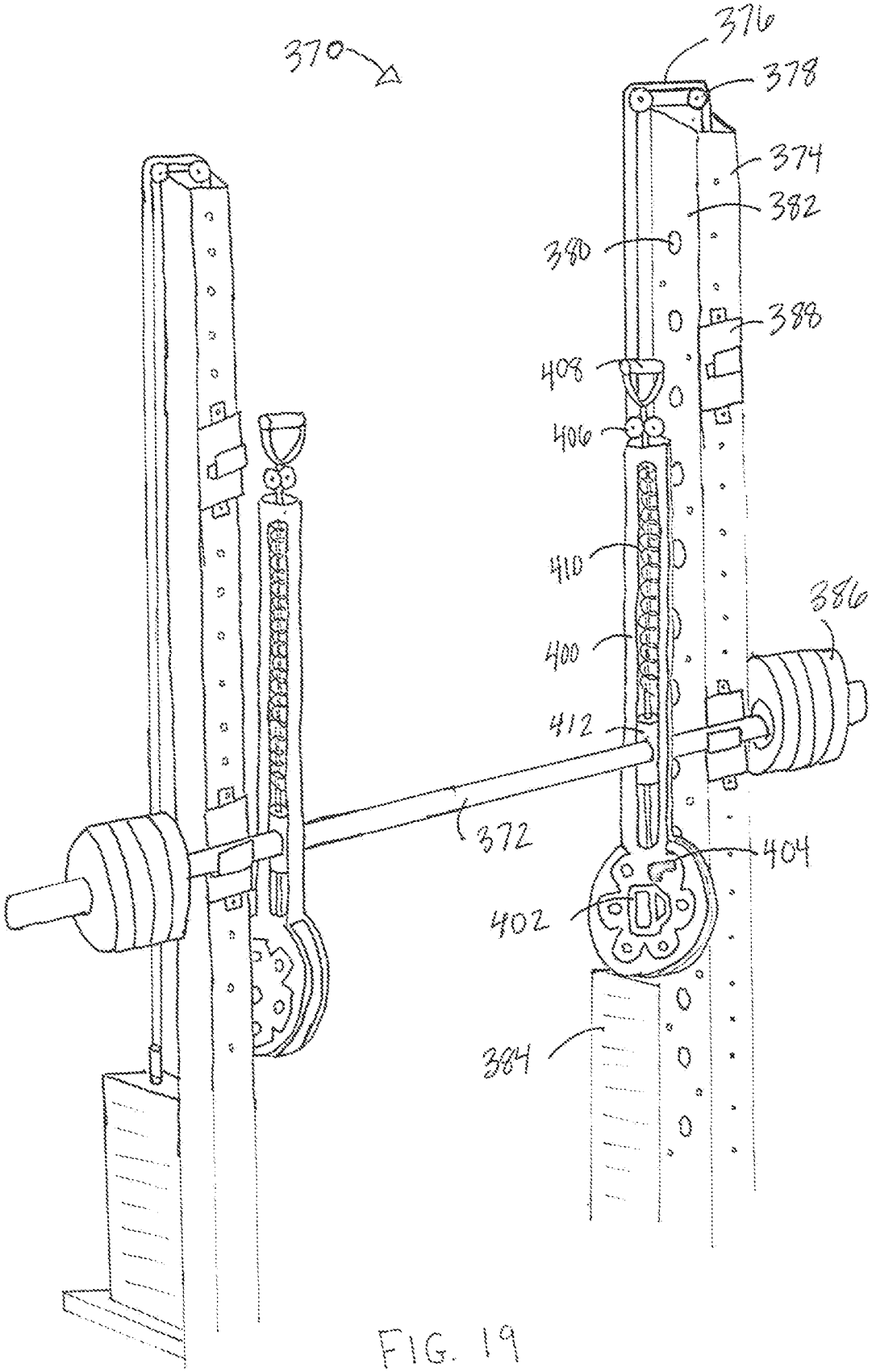
FIG. 19 illustrates a perspective view of a weight training system in an embodiment of the present invention.

As shown in FIG. 19, an embodiment is shown and described. A weight lifting apparatus 370 may comprise a plurality of arm apparatuses 400, a weight bar 372, a plurality of vertical columns 374, a plurality of cables 376, and a plurality of pulley systems 378. The vertical columns 374 may be hollow such that cables 376 may move internally and independently of vertical columns 374. The vertical columns 374 may comprise height slots 380 and locking holes 382. Height slots 380 may be used to lock in arm apparatus 400 to vertical columns 374 via pull-release handles 402. Locking holes 382 may be used to lock arm apparatus 400 at a specific angle to vertical columns 374 via a locking pin 404. Pulley systems 378 may be disposed at the top of vertical columns 374 to rotate cables 376 one hundred eighty degrees. Cable 376 may be secured to a weight stack 384 at one end, span the length of a vertical column 374, contact a pulley system 378, span the length between the pulley system 378 and arm apparatus 400, enter arm apparatus 400 and span the length of arm apparatus 400, pass through an arm pulley system 406, and be secured to a cable handle 408 at the other end thereof. A cable 376 may be pulled via cable handle 408, lifting isotonically the connecting weight stack 384. A compression spring 410 may be engaged independently of a mounting device 412 by cable 376. Arm pulley system 406 and cable 376 may rotate 360 degrees during any exercise. Weight bar 372 may be separable as to allow weight bar 372 to be inserted and removed from arm apparatuses 400. Weight bar 372 may be used to lift weight plates 386 isotonically. Weight bar 372 may be threaded through mounting device 412 and engage compression spring 410, thereby increasing resistance through the repetition as the muscle or muscles of the user contracts. Vertical columns 374 may comprise weight bar rests 388 to hold weight bar 372 when not in use. Weight bar 372 and arm apparatuses 400 may comprise alternate embodiments as discussed above, and are not limited to function described by this figure.

Figure 20:
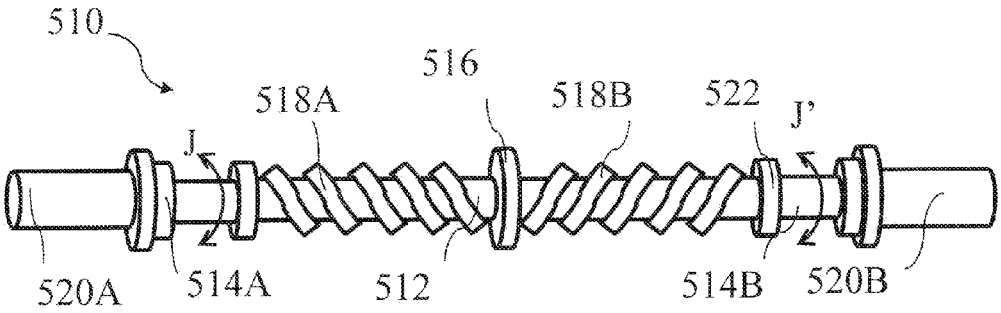
FIG. 20 illustrates a perspective view of a bar with additional resistance training components capable of adduction in an alternate embodiment of the present invention.

As shown in FIG. 20, an alternate embodiment of a weight bar with additional resistance training components is shown and described. The weight bar is an apparatus 510 that may comprise a core bar 512, a left-hand grip 514A, a right-hand grip 514B, a center brace 516, a left-hand compression spring 518A, a right-hand compression spring 518B, a left-hand weight mount 520A, and a right-hand weight mount 520B. Center brace 516 may be disposed about the middle of core bar 512. Left-hand weight mount 520A may be secured to one end of core bar 512 and right-hand weight mount 520B may be secured to an opposite end of core bar 512. Left-hand weight mount 520A and right-hand weight mount 520B may be separable from core bar 512 to allow insertion of alternate hand grips (not shown) and alternate springs (not shown) with varying resistance and to allow alternate arrangements as seen in the following figures. Left-hand grip 514A may be disposed at one end of core bar 512, adjacent left-hand weight mount 520A. Right-hand grip 514B may be disposed at an opposite end of core bar 512, adjacent right-hand weight mount 520B. Left-hand grip 514A may be able to rotate 360 degrees along path J, about the longitudinal or roll axis. Right-hand grip 514B may be able to rotate 360 degrees along path J', about the longitudinal or roll axis. Left-hand grip 514A and right-hand grip 514B may comprise a plurality of spring plates 522 that may engage left-hand compression spring 518A and right-hand compression spring 518B.

Figure 21:
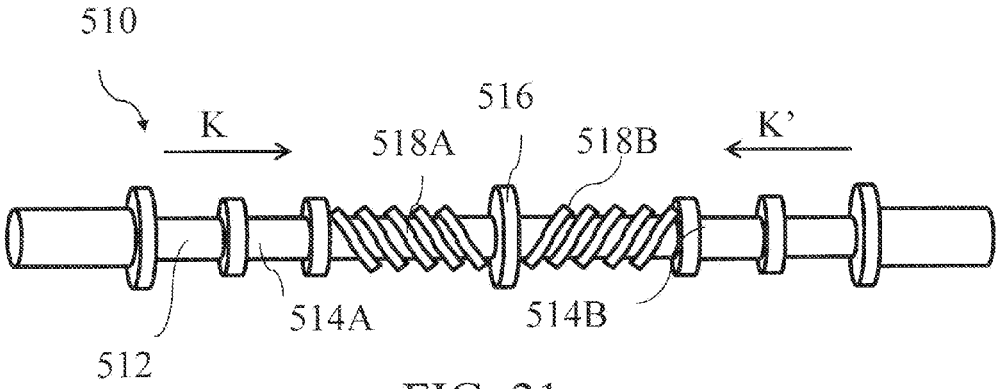
FIG. 21 illustrates a perspective view of a bar with additional resistance training components partially compressed via adduction.

As shown in FIG. 21, apparatus 510 is shown partially adducted. Left-hand grip 514A may advance down core bar 512 along path K engaging left-hand compression springs 518A. Right-hand grip 514B may advance down core bar 512 along path K' and engage right-hand compression spring 518B. As left-hand grip 514A and right-hand grip 514B advance closer to center brace 516, the resistance becomes stronger and the isometric force required becomes larger as the user's muscle or muscles contract.

Figure 22:
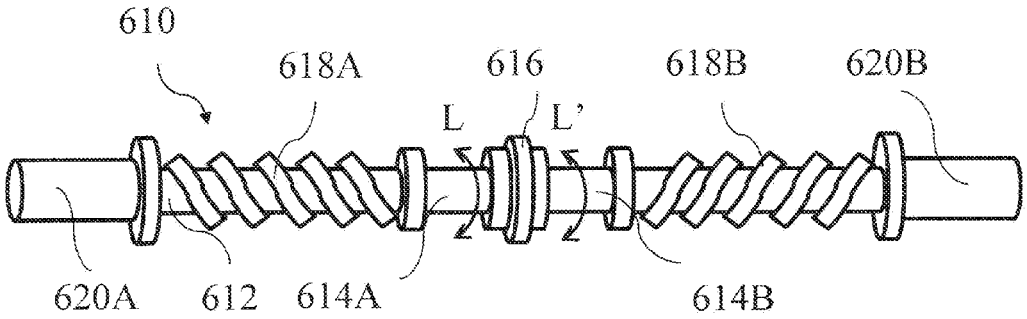
FIG. 22 illustrates a perspective view of a bar with additional resistance training components capable of abduction in an alternate embodiment of the present invention.

As shown in FIG. 22, an alternate embodiment of a weight bar with additional resistance training components is shown and described. The weight bar is an apparatus 610 that may comprise a core bar 612, a left-hand grip 614A, a right-hand grip 614B, a center brace 616, a left-hand compression spring 618A, a right-hand compression spring 618B, a left-hand weight mount 620A, and a right-hand weight mount 620B. Left-hand weight mount 620A may be secured to one end of core bar 612 and right-hand weight mount 620B may be secured to opposite end of core bar 612. Left-hand weight mount 620A and right-hand weight mount 620B may be separable from core bar 612 to allow insertion of alternate hand grips (not shown) and alternate springs (not shown) with other resistances, and to allow alternate arrangements as seen in the following figures. Center brace 616 may be disposed about the middle of core bar 612. Left-hand grip 614A may be able to rotate 360 degrees along path L, about the longitudinal or roll axis. Right-hand grip 614B may be able to rotate 360 degrees along path L', about the longitudinal or roll axis. Left-hand grip 614A may advance along core bar 612 away from center brace 616 and engage left-hand compression spring 618A. Right-hand grip 614B may advance along core bar 612 away from center brace 616 and engage right-hand compression spring 618B.

Figure 23:
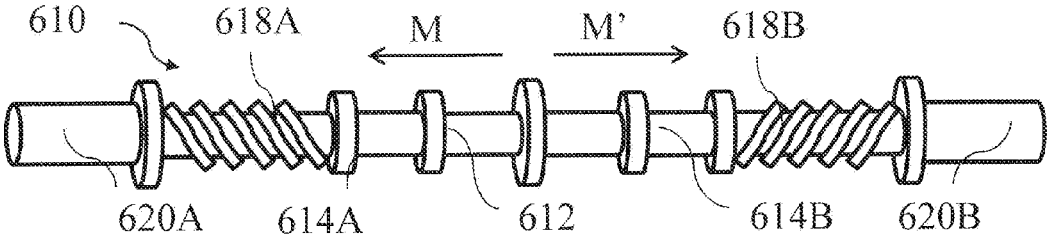
FIG. 23 illustrates a perspective view of a bar with additional resistance training components partially compressed via abduction.

As shown in FIG. 23, apparatus 610 is shown partially abducted. Left-hand grip 614A may advance about core bar 612 along path M, engaging left-hand compression spring 618A. As left-hand grip 614A advances closer to left-hand weight mount 620A, the resistance becomes stronger and the isometric force required becomes larger. Right-hand grip 614B may advance about core bar 612 along path M', engaging right-hand compression spring 618B. As right-hand grip 614B advances closer to right-hand weight mount 620B, the resistance becomes stronger and the isometric force required becomes larger.

Figure 24:
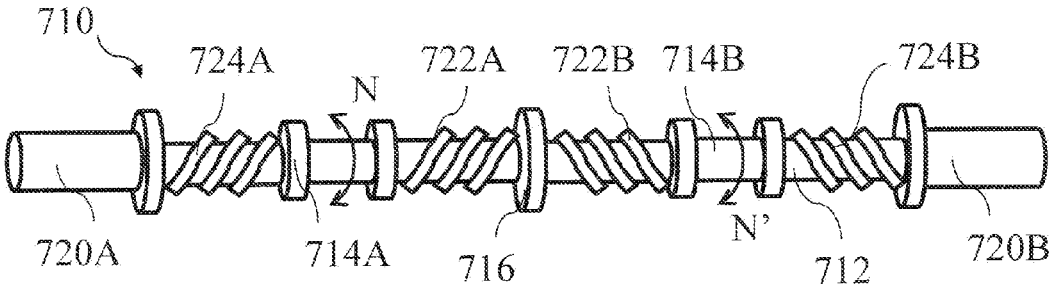
FIG. 24 illustrates a perspective view of a bar with additional resistance training components capable of both adduction and abduction in an alternate embodiment of the present invention.

As shown in FIG. 24, an alternate embodiment of a weight bar with additional resistance training components is shown and described. The weight bar is an apparatus 710 that may comprise a core bar 712, a left-hand grip 714A, a right-hand grip 714B, a center brace 716, a left-hand weight mount 720A, a right-hand weight mount 720B, a left-hand adduction spring 722A, a right-hand adduction spring 722B, a left-hand abduction spring 724A, and a right-hand abduction spring 724B. Center brace 716 may be disposed about the middle of core bar 712. Left-hand weight mount 720A may be secured to one end of core bar 712 and right-hand weight mount 720B may be secured to opposite end of core bar 712. Left-hand weight mount 720A and right-hand weight mount 720B may be separable from core bar 712 to allow insertion of alternate hand grips (not shown) and alternate springs (not shown) with other resistances, and to allow alternate arrangements as seen in previous figures. Left-hand grip 714A may be disposed midway between left-hand weight mount 720A and center brace 716. Right-hand grip 714B may be disposed midway between right-hand weight mount 720B and center brace 716. Left-hand grip 714A may be able to rotate 360 degrees along path N. Right-hand grip 714B may be able to rotate 360 degrees along path N'. Left-hand grip 714A may advance along core bar 712 towards center brace 716 and engage left-hand adduction spring 722A. Right-hand grip 714B may advance along core bar 712 towards center brace 716 and engage right-hand adduction spring 722B. Left-hand grip 714A may advance along core bar 712 towards left-hand weight mount 720A and engage left-hand abduction spring 724A. Right-hand grip 714B may advance along core bar 712 towards right-hand weight mount 720B and engage right-hand abduction spring 724B.

Figure 25:
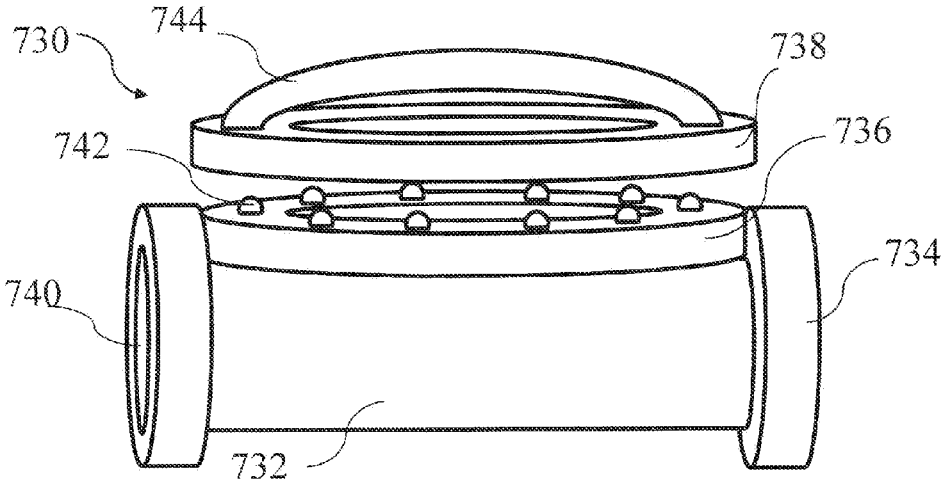
FIG. 25 illustrates a perspective view of an alternate hand grip for use with an alternate embodiment of the present invention.

As shown in FIG. 25, an alternate hand grip is shown and described. An apparatus 730 may comprise a weight bar cover 732, a plurality of spring plates 734, a base plate 736, and a handle plate 738. The weight bar cover 732 may comprise a cylindrical hole 740 to allow weight bar cover 732 to be slid onto a weight bar (not shown). The spring plates 734 may be used to engage compression springs (not shown). The base plate 736 may comprise a plurality of ball bearings 742 and may be secured to weight bar cover 732 on one side. Handle plate 738 may be disposed on top of base plate 736 so that handle plate 738 may rotate 360 degrees. Handle plate 738 may comprise a hand grip 744 for maneuvering handle plate 738.

Figure 26:
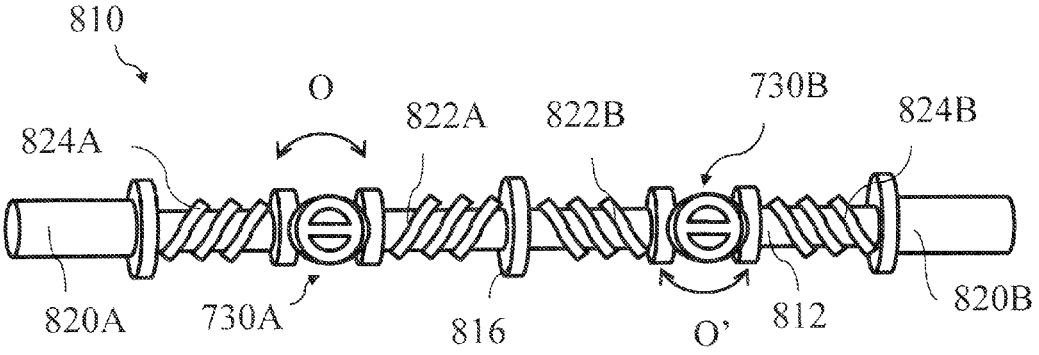
FIG. 26 illustrates a perspective view of a bar with additional resistance training components capable of both adduction and abduction with alternate hand grips in an alternate embodiment of the present invention.

As shown in FIG. 26, an alternate embodiment of a weight bar with additional resistance training components is shown and described. The weight bar is an apparatus 810 that may comprise a core bar 812, a left alternate hand grip 730A, a right alternate hand grip 730B, a center brace 816, a left-hand weight mount 820A, a right-hand weight mount 820B, a left-hand adduction spring 822A, a right-hand adduction spring 822B, a left-hand abduction spring 824A, and a right-hand abduction spring 824B. Left-hand weight mount 820A may be secured to one end of core bar 812 and right-hand weight mount 820B may be secured to an opposite end of core bar 812. Left-hand weight mount 820A and right-hand weight mount 820B may be separable from core bar 812 to allow removal and insertion of hand grips (not shown) and alternate springs (not shown) with other resistances, and to allow alternate arrangements as seen in previous figures. Left alternate hand grip 730A may be disposed midway between left-hand weight mount 820A and center brace 816. Right alternate hand grip 730B may be disposed midway between right-hand weight mount 820B and center brace 816. Left alternate hand grip 730A may be able to rotate 360 degrees along path O, rotating about the lateral or pitch axis. Right alternate hand grip 730B may be able to rotate 360 degrees along path O', rotating about the lateral or pitch axis. Left alternate hand grip 730A may advance along core bar 812 towards center brace 816 and engage left-hand adduction spring 822A. Left alternate hand grip 730A may advance along core bar 812 towards left-hand weight mount 820A and engage left-hand abduction spring 824A. Right alternate hand grip 730B may advance along core bar 812 towards center brace 816 and engage right-hand adduction spring 822B. Right alternate hand grip 730B may advance along core bar 812 towards right-hand weight mount 820B and engage right-hand abduction spring 824B.

Figure 27:
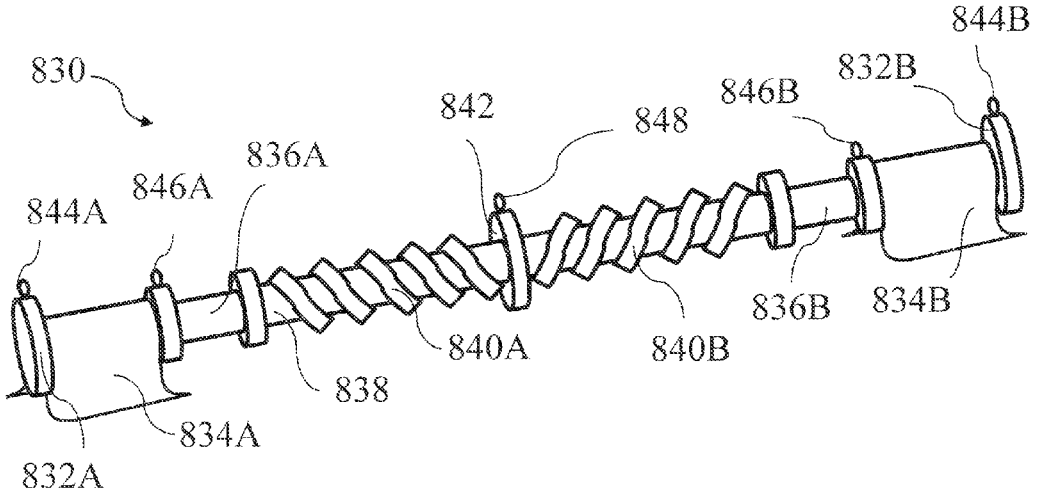
FIG. 27 illustrates a perspective view of a bar with additional resistance training components capable of adduction to be mounted on the floor in an alternate embodiment of the present invention.

As shown in FIG. 27, an alternate embodiment of a weight bar with additional resistance training components is shown and described. The weight bar is an apparatus 830 that may comprise a left-hand end cap 832A, a right-hand end cap 832B, a left-hand stand 834A, a right-hand stand 834B, a left-hand grip 836A, a right-hand grip 836B, a separable core bar 838, a left-hand compression spring 840A, a right-hand compression spring 840B, and a center brace 842. Center brace 842 may be disposed about the middle of separable core bar 838. Left-hand stand 834A may be disposed about separable core bar 838 near one end and may be used to support apparatus 830 above and level to the ground. Right-hand stand 834B may be disposed about separable core bar 838 near an opposite end and may be used to support apparatus 830 above and level to the ground. Left-hand end cap 832A may be secured to separable core bar 838 at one end and right-hand end cap 832B may be secured to separable core bar 838 at opposite end. Left-hand end cap 832A may be removable to allow left-hand stand 834A, left-hand grip 836A, and left-hand compression spring 840A to be removed or rearranged on separable core bar 838. Right-hand end cap 832B may be removable to allow right-hand stand 834B, right-hand grip 836B, and right-hand compression spring 840B to be removed or rearranged on separable core bar 838. Apparatus 830 may be used for adduction or abduction purposes, depending on arrangement of left-hand grip 836A, left-hand compression spring 840A, right-hand grip 836B, and right-hand compression spring 840B. FIG. 27 shows adduction; by switching left-hand grip 836A with left-hand compression spring 840A, and right-hand grip 836B with right-hand compression spring 840B, abduction is possible. Left-hand end cap 832A may comprise a left-hand outer attaching device 844A to tie resistance bands for greater adduction loads. Right-hand end cap 832B may comprise a right-hand outer attaching device 844B to tie resistance bands for greater adduction loads. Left-hand grip 836A may be disposed near left-hand stand 834A, opposite left-hand end cap 832A and about separable core bar 838. Right-hand grip 836B may be disposed near right-hand stand 834B, opposite right-hand end cap 832B and about separable core bar 838. Left-hand grip 836A may comprise a left-hand active attaching device 846A to tie resistance bands (not shown) for greater adduction or abduction loads. Right-hand grip 836B may comprise a right-hand active attaching device 846B to tie resistance bands (not shown) for greater adduction or abduction loads. Left-hand grip 836A and right-hand grip 836B may advance along separable core bar 838 towards center brace 842. Left-hand grip 836A may engage left-hand compression spring 840A adding additional resistance training. Right-hand grip 836B may engage right-hand compression spring 840B adding additional resistance training. Tying resistance bands (not shown) the length between left-hand outer attaching device 844A and left-hand active attaching device 846A may allow adduction resistance to be added when left-hand grip 836A advances toward center brace 842. Tying resistance bands (not shown) the length between right-hand outer attaching device 844B and right-hand active attaching device 846B may allow adduction resistance to be added when right-hand grip 836B advances toward center brace 842. Center brace 842 may comprise a center attaching device 848 to tie resistance bands (not shown). Tying resistance bands (not shown) the length between the center attaching device 848 and left-hand active attaching device 846A may allow abduction resistance to be added when left-hand grip 836A advances towards left-hand stand 834A. Tying resistance bands (not shown) the length between the center attaching device 848 and right-hand active attaching device 846B may allow abduction resistance to be added when right-hand grip 836B advances towards right-hand stand 834B. Apparatus 830 may be placed on the ground and used in push-up exercises.

Figure 28:
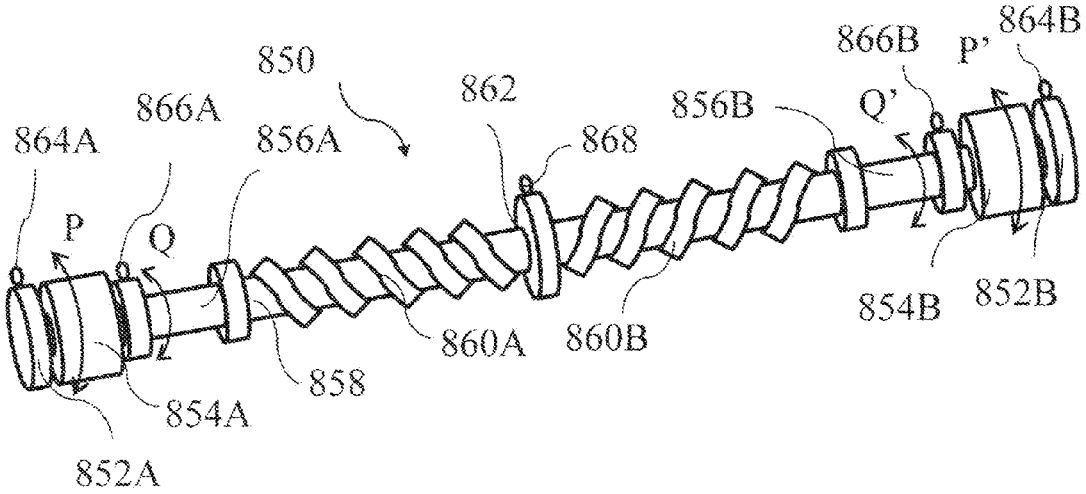
FIG. 28 illustrates a perspective view of a bar with additional resistance training components capable of adduction to be rolled on the floor in an alternate embodiment of the present invention.

As shown in FIG. 28, an alternate embodiment of a weight bar with additional resistance training components is shown and described. The weight bar is an apparatus 850 that may comprise a left-hand end cap 852A, a right-hand end cap 852B, a left-hand roller 854A, a right-hand roller 854B, a left-hand grip 856A, a right-hand grip 856B, a separable core bar 858, a left-hand compression spring 860A, a right-hand compression spring 860B, and a center brace 862. Center brace 862 may be disposed about the middle of separable core bar 858. Left-hand roller 854A may be disposed about separable core bar 858 near one end and may be able to rotate 360 degrees along path P, about the longitudinal or roll axis. Right-hand roller 854B may be disposed about separable core bar 858 near opposite end and may be able to rotate 360 degrees along path P', about the longitudinal or roll axis. Left-hand roller 854A and right-hand roller 854B may be used upon the ground in order to move apparatus 850 laterally along the ground. Separable core bar 858 may remain static during lateral motion of apparatus 850 while left-hand roller 854A and right-hand roller 854B rotate independently, thereby inducing movement. Left-hand end cap 852A may be secured to core bar 858 at one end and right-hand end cap 852B may be secured to core bar 858 at an opposite end. Left-hand end cap 852A may be removable to allow left-hand roller 834A, left-hand grip 836A, and left-hand compression spring 840A to be removed or rearranged on separable core bar 858. Right-hand end cap 852B may be removable to allow right-hand roller 834B, right-hand grip 836B, and right-hand compression spring 840B to be removed or rearranged on separable core bar 858. Apparatus 850 may be used for adduction or abduction purposes, depending on arrangement of left-hand grip 856A, left-hand compression spring 860A, right-hand grip 856B, and right-hand compression spring 860B. FIG. 28 shows adduction; by switching left-hand grips 856A with left-hand compression spring 860, and switching right-hand grip 856B and right-hand compression spring 860B, abduction is possible. Left-hand end cap 842A may comprise a left-hand outer attaching device 864A to tie resistance bands for greater adduction loads. Right-hand end cap 842B may comprise a right-hand outer attaching device 864B to tie resistance bands for greater adduction loads. Left-hand grip 856A may be disposed near left-hand roller 854A opposite left-hand end cap 852A and about separable core bar 858. Right-hand grip 856B may be disposed near right-hand roller 854B opposite right-hand end cap 852B and about separable core bar 858. Left-hand grip 856A may comprise a left-hand active attaching device 866A to tie resistance bands (not shown) for greater adduction or abduction loads. Right-hand grip 856B may comprise a right-hand active attaching device 866B to tie resistance bands (not shown) for greater adduction or abduction loads. Left-hand grip 856A and right-hand grip 856B may advance along separable core bar 858 towards center brace 862. Left-hand grip 856A may engage left-hand compression spring 860A adding additional resistance training. Right-hand grip 856B may engage right-hand compression spring 860B adding additional resistance training. Tying resistance bands (not shown) the length between left-hand outer attaching device 864A and left-hand active attaching device 866A may allow adduction resistance to be added when left-hand grip 856A advances toward center brace 862. Tying resistance bands (not shown) the length between right-hand outer attaching device 864B and right-hand active attaching device 866B may allow adduction resistance to be added when right-hand grip 856B advances toward center brace 862. Center brace 842 may comprise a center attaching device 868 to tie resistance bands (not shown). Tying resistance bands (not shown) the length between the center attaching device 868 and left-hand active attaching device 866A may allow abduction resistance to be added when left-hand grip 856A advances towards left-hand roller 854A. Tying resistance bands (not shown) the length between the center attaching device 868 and right-hand active attaching device 866B may allow abduction resistance to be added when right-hand grip 856B advances towards right-hand roller 854B. Left-hand grip 856A may rotate 360 degrees along path Q, about the longitudinal or roll axis, allowing independent motion from left-hand roller 854A and separable core bar 858. Right-hand grip 856B may rotate 360 degrees along path Q', about the longitudinal or roll axis, allowing independent motion from right-hand roller 854B and separable core bar 858. Apparatus 850 may be placed on the ground and used in abdominal rolling exercises.

Figure 29:
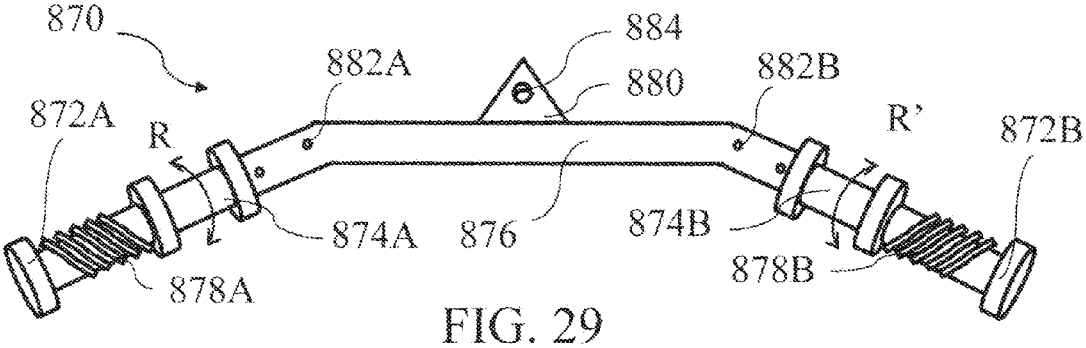
FIG. 29 illustrates a perspective view of a pull-down bar with additional resistance training components capable of abduction in an alternate embodiment of the present invention.

As shown in FIG. 29, an alternate embodiment of a pull-down bar with additional resistance training components capable of abduction is shown and described. The pull-down bar is apparatus 870 that may comprise a left-hand end cap 872A, a right-hand end cap 872B, a left-hand grip 874A, a right-hand grip 874B, a core bar 876, a left-hand compression spring 878A, a right-hand compression spring 878B, a mounting harness 880, a left set of locking pins 882A, and a right set of locking pins 882B. Left-hand end cap 872A and right-hand end cap 872B may be removable to allow insertion of alternate compression springs (not shown) with other resistances. Core bar 876 may bend at each end to allow wider applications. Left-hand grip 874A may be able to rotate 360 degrees along path R, about the longitudinal or roll axis, and advance along core bar 876 towards left-hand end cap 872A. Left-hand grip 874A may engage left-hand compression spring 878A for addition abduction resistance during exercise. Right-hand grip 874B may be able to rotate 360 degrees along path R', about the longitudinal or roll axis, and advance along core bar 876 towards right-hand end cap 872B. Right-hand grip 874B may engage right-hand compression spring 878B for addition abduction resistance during exercise. Mounting harness 880 may be attached to a cable and pulley system (not shown) through attaching hole 884, allowing pull-down weight training. Left-hand grip 874A may lock to core bar 876 using left set of locking pins 882A when additional abduction resistance is undesirable. Right-hand grip 874B may lock to core bar 876 using right set of locking pins 882B when additional abduction resistance is undesirable. Apparatus 870 may generally be used for pull-down exercises.

Figure 30:
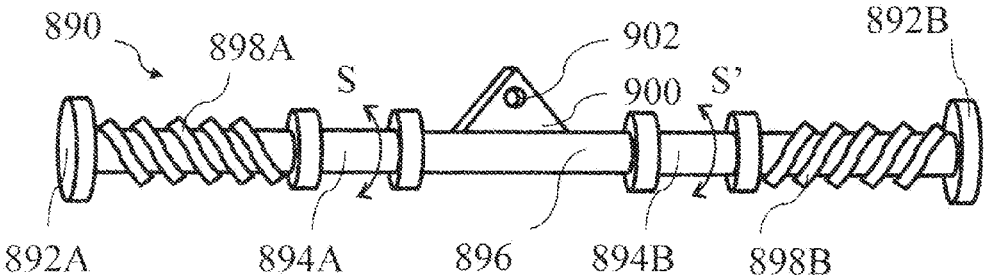
FIG. 30 illustrates a perspective view of a pull-down straight bar with additional resistance training components capable of abduction in an alternate embodiment of the present invention.

As shown in FIG. 30, an alternate embodiment of a pull-down straight bar with additional resistance training components capable of abduction is shown and described. An apparatus 890 may comprise a left-hand end cap 892A, a right-hand end cap 892B, a left-hand grip 894A, a right-hand grip 894B, a core bar 896, a left-hand compression spring 898A, a right-hand compression spring 898B, and a mounting harness 900. Left-hand end cap 892A and right-hand end cap 892B may be removable to allow insertion of alternate compression springs (not shown) with differing resistance. Left-hand grip 894A may be able to rotate 360 degrees along path S, about the longitudinal or roll axis, and advance along core bar 896 towards left-hand end cap 892A. Right-hand grip 894B may be able to rotate 360 degrees along path S', about the longitudinal or roll axis, and advance along core bar 896 towards right-hand end cap 892B. Left-hand grip 894A may engage left-hand compression spring 898A for additional abduction resistance during exercise. Right-hand grip 894B may engage right-hand compression spring 898B for additional abduction resistance during exercise. Mounting harness 900 may be attached to a cable and pulley system (not shown) through attaching hole 902, allowing isotonic weight training. Apparatus 890 may be used for pull-down exercises.

Figure 31:
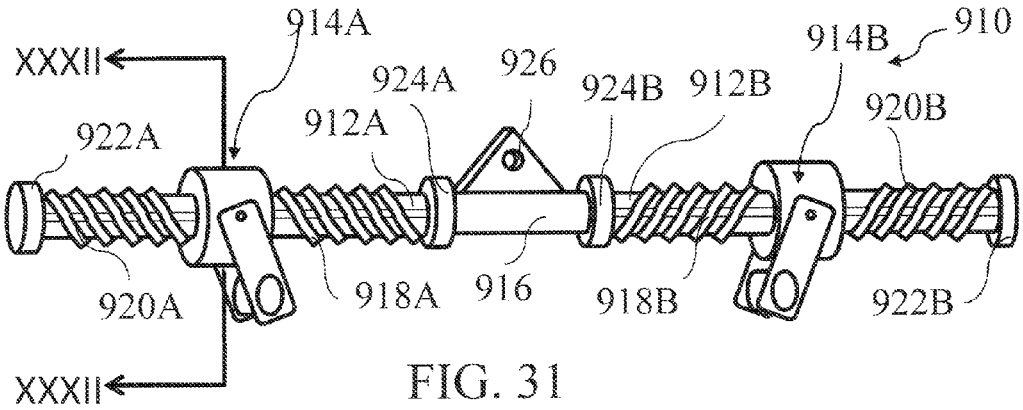
FIG. 31 illustrates a perspective view of a pull-down straight bar with additional resistance training components capable of both adduction and abduction in an alternate embodiment of the present invention.

As shown in FIG. 31, an alternate embodiment of a pull-down straight bar with additional resistance training components capable of both adduction and abduction is shown and described. The pull-down straight bar is an apparatus 910 that may comprise a left partial core bar 912A, a right partial core bar 912B, a left-hand compression mechanism 914A, a right-hand compression mechanism 914B, a center mounting harness 916, a left-hand adduction spring 918A, a right-hand adduction spring 918B, a left-hand abduction spring 920A, a right-hand abduction spring 920B, a left-hand end cap 922A, and a right-hand end cap 922B. Center mounting harness 916 may stet about the middle of apparatus 910. Left-hand compression mechanism 914A may be disposed midway between left-hand end cap 922A and the center mounting harness 916 on one end. Right-hand compression mechanism 914B may be disposed midway between right-hand end cap 922B and the center mounting harness 916 on opposite end. The left-hand compression mechanism 914A may advance along left partial core bar 912A towards center mounting harness 916 and engage left-hand adduction spring 918A. The right-hand compression mechanism 914B may advance along right partial core bar 912B towards center mounting harness 916 and engage right-hand adduction spring 918B. The left-hand compression mechanism 914A may advance along left partial core bar 912A towards left-hand end cap 922A and engage left-hand abduction spring 920A. The right-hand compression mechanism 914B may advance along right partial core bar 912B towards right-hand end cap 922B and engage right-hand abduction spring 920B. Center mounting harness may comprise a left center cap 924A and a right center cap 924B. Left center cap 924A may secure left partial core bar 912A together with left-hand end cap 922A. Right center cap 924B may secure right partial core bar 912B together with right-hand end cap 922B. Center mounting harness 916 may be attached to a cable and pulley system (not shown) through attaching hole 926, allowing isotonic weight training. Apparatus 910 may be used for pull-down isotonic exercises or adduction and abduction resistance exercises.

Figure 32:
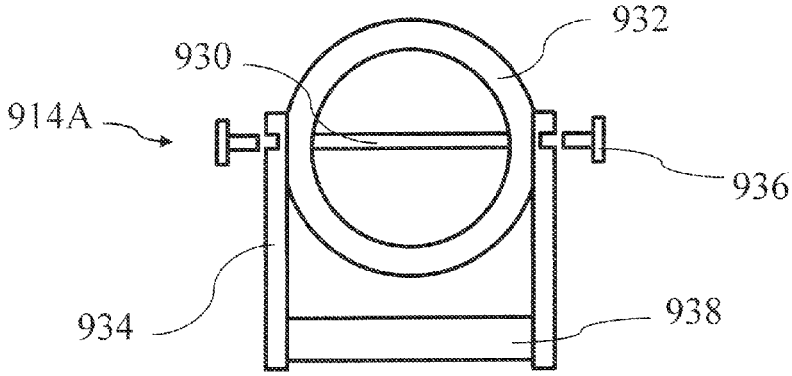
FIG. 32 illustrates a cross-sectional view of a handle apparatus for use in the pull-down straight bar capable of both adduction and abduction.

As shown in FIG. 32, a cross-sectional view of left-hand compression mechanism 914A is shown and described. Left-hand compression mechanism 914A may comprise a compression bolt 930, a plurality of spring plates 932, a handle 934, and a plurality of screws 936. Handle 934 may comprise a hand grip 938 for manipulation. Handle 934 may be secured or otherwise connected to spring plates 932 by screws 936. Screws 936 may secure compression bolt 930 to spring plates 932. Compression bolt 930 and spring plates 932 may be used to engage a compression spring (not shown).

Figure 33:
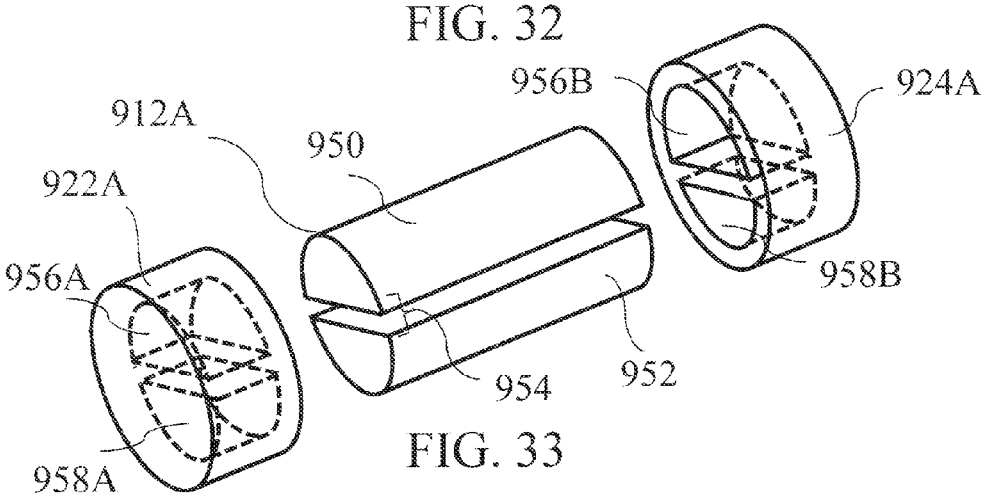
FIG. 33 illustrates a perspective sectional view of the pull-down straight bar without the handle apparatus and additional resistance training components.

As shown in FIG. 33, a sectional view of left partial core bar 912A is shown and described. Left partial core bar 912A may comprise a top core 950 and a bottom core 952. Separating left partial core bar 912A into two halves creates a compression sleeve 954 for a compression bolt (not shown) to pass through. Left-hand end cap 922A may comprise a top end slot 956A and a bottom end slot 958A. Left center cap 924A may comprise a top center slot 956B and a bottom center slot 958B. The top end slot 956A and bottom end slot 958A may extend half the length of left-hand end cap 922A or enough to support left partial core bar 912A. The top center slot 956B and bottom center slot 958B may extend half the length of left center cap 924B or enough to support left partial core bar 912A. The top core 950 may be inserted into top center slot 956B on left center cap 924A and into top end slot 956A on left-hand end cap 922A, securing the top half of core bar 912. The bottom core 952 may be inserted into the bottom center slot 958B on left center cap 924A and into the bottom end slot 958A on left-hand end cap 922A, securing the bottom half of core bar 912. Compression sleeve 954 may extend the length of core bar 912 between left-hand end cap 922A and left center cap 924A.

Figure 34:
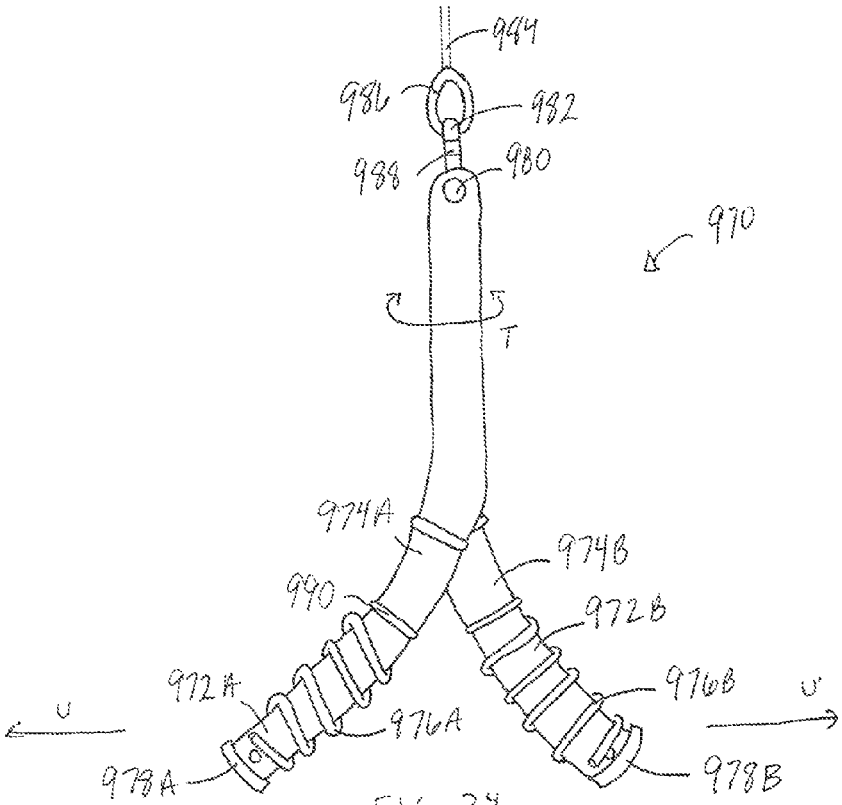
FIG. 34 illustrates a perspective view of a triceps pull down bar with additional resistance training components capable of abduction in an alternate embodiment of the present invention.

As shown in FIG. 34, an alternate embodiment of a triceps pull-down bar with additional resistance training components capable of abduction is shown and described. The triceps pull-down bar is an apparatus 970 that may comprise a core bar 972A, a core bar 972B, a hand grip 974A, a hand grip 974B, a compression spring 976A, a compression spring 976B, an end cap 978A, and an end cap 978B. Core bar 972A and core bar 972B may be cylindrical and arcuate throughout their entireties. Core bar 972A may arc outwardly along path U and core bar 972B may arc outwardly along path U' producing the symmetrical apparatus 970. Core bar 972A and core bar 972B may be connected together by an axle 980 passed through one end of both core bar 972A and core bar 972B. The axle 980 may allow core bar 972A and core bar 972B to rotate freely and independently around axle 980. Axle 980 may comprise an eye hook 982. Eye hook 982 may be connected to a cable 984 via a carabineer clip 986 or other linking device known to one in the art. Cable 984 may be attached to a weight stack (not shown) to allow isotonic weight training. Eye hook 982 may comprise a spindle 988 that allows apparatus 970 to rotate 360 degrees along path T. Hand grip 974A may be disposed about the middle of core bar 972A and hand grip 974B may be disposed about the middle of core bar 972B. Hand grip 974A and hand grip 974B may comprise a plurality of spring plates 990. Spring plates 990 may be used to engage compression spring 976A and compression spring 976B. Spring plates 990 may be used to prevent an individual's hand from slipping off hand grip 974A and hand grip 974B. Hand grip 974A and hand grip 974B may be cylindrical and arcuate so they may advance along the entireties of core bar 972A and core bar 972B respectively. End cap 978A may be disposed at one end of core bar 972A opposite of axle 980. End cap 978B may be disposed at one end of core bar 972B opposite of axle 980. Compression spring 976A may be disposed the length between end cap 978A and hand grip 974A along core bar 972A. Compression spring 976B may be disposed the length between end cap 978B and hand grip 974B along core bar 972B. End cap 978A may be affixed to a pivot (not shown). Pivot (not shown) may be disposed about and at end of core bar 972A near end cap 978A via a spindle axle 994A. End cap 978B may be affixed to a pivot (not shown). Pivot (not shown) may be disposed about and at end of core bar 972B near end cap 978B via a spindle axle 994B.

Hand grip 974A may advance along core bar 972A towards end cap 978A and engage compression spring 976A. Hand grip 974B may advance along core bar 972B towards end cap 978B and engage compression spring 976B. Core bar 972A may extend outwardly along path U, rotating about axle 980, as hand grip 974A advances toward end cap 978A. Core bar 972B may extend outwardly along path U', rotating about axle 980, as hand grip 974B advances toward end cap 978B. Core bar 972A and core bar 972B may be pulled downwards, pulling cable 984, and lifting weight stack (not shown) for isotonic weight training. Extending core bar 972A outwardly along path U and engaging compression spring 976A with hand grip 974A while simultaneously extending core bar 972B outwardly along path U' and engaging compression spring 976B with hand grip 974B with during isotonic weight training may add additional resistance training throughout arc of motion. End cap 978A and end cap 978B may be removable to allow insertion of alternate hand grips (not shown) or alternate springs (not shown) with varying resistance and to allow alternate arrangements (not shown).

Figure 35:
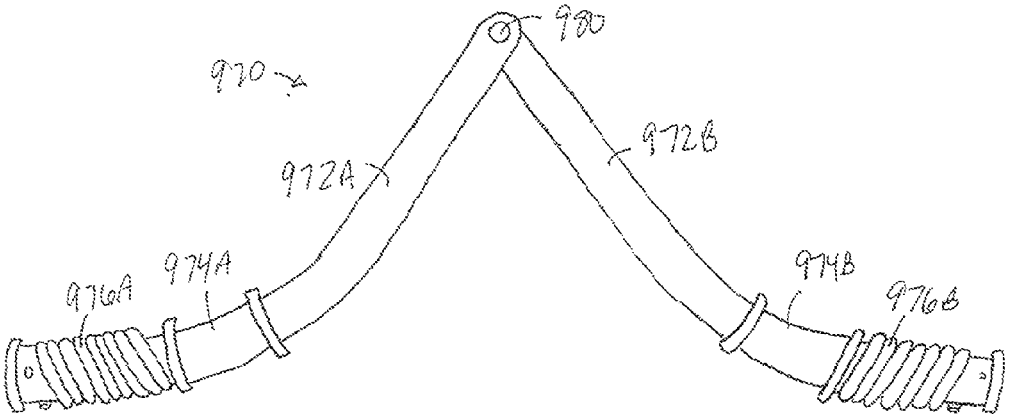
FIG. 35 illustrates a perspective view of a triceps pull down bar with additional resistance training components fully compressed via abduction.

As seen in FIG. 35, an alternate view of apparatus 970 is shown and described. Hand grip 974A may be fully advanced along core bar 972A, completely engaging compression spring 976A, and completely extending core bar 972A about axle 980. Hand grip 974B may be fully advanced along core bar 972B, completely engaging compression spring 976B, and completely extending core bar 972B about axle 980.

Figure 36:
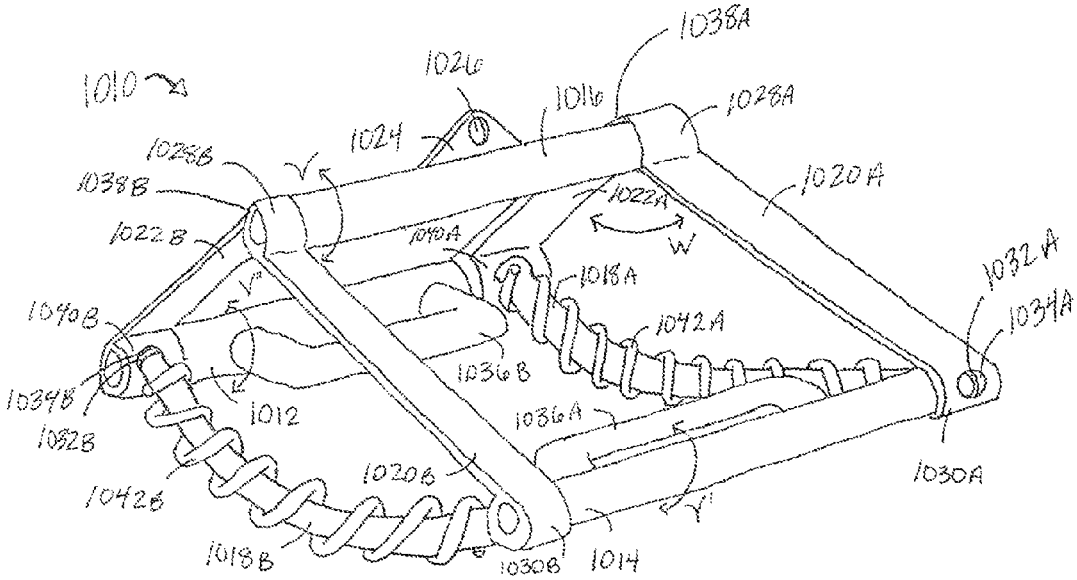
FIG. 36 illustrates a perspective view of a v-grip compression bar with additional resistance training components capable of adduction in an alternate embodiment of the present invention.

As seen in FIG. 36, an alternate embodiment of a seated row bar apparatus 1010 is shown and described. The apparatus 1010 may comprise a left-hand cylindrical core bar 1012, a right-hand cylindrical core bar 1014, an anchoring cylindrical core bar 1016, a plurality of arcuate cylindrical core bars 1018A,1018B, a plurality of right-hand interlocking flat bars 1020A,1020B, and a plurality of left-hand interlocking flat bars 1022A,1022B. Anchoring cylindrical core bar 1016 may comprise a mounting triangular plate 1024. Mounting triangular plate 1024 may be disposed at half the length of anchoring cylindrical core bar 1016. Mounting triangular plate 1024 may comprise an attaching hole 1026 to allow apparatus 1010 to be connected to a cable system (not shown) for use in isotonic weight training.

Anchoring cylindrical core bar 1016 may be connected to right-hand cylindrical core bar 1014 via right-hand interlocking flat bar 1020A at one end and right-hand interlocking flat bar 1020B at the other end. Right-hand interlocking flat bar 1020A may comprise a top cylindrical tube 1028A at one end and a bottom cylindrical tube 1030A at the other end. Top cylindrical tube 1028A may be disposed on a topside of right-hand interlocking flat bar 1020A and may allow anchoring cylindrical core bar 1016 to be placed within top cylindrical tube 1028A so that anchoring cylindrical core bar 1016 may rotate 360 degrees along path V. Bottom cylindrical tube 1030A may be disposed on an underside of right-hand interlocking flat bar 1020A and may allow right-hand cylindrical core bar 1014 to be placed within bottom cylindrical tube 1030A so that right-hand cylindrical core bar 1014 may rotate 360 degrees along path V'. Right-hand cylindrical core bar 1014 may comprise a cylindrical arcuate hole 1032A at one end so that arcuate cylindrical core bar 1018A may pass through. Bottom cylindrical tube 1030A may comprise an arcuate hole 1034A so that arcuate cylindrical core bar 1018A may pass through. Right-hand cylindrical core bar 1014 may terminate before arcuate hole 1034A within bottom cylindrical tube 1030A so that arcuate cylindrical core bar 1018A may pass beyond right-hand cylindrical core bar 1014 and through arcuate hole 1034A. Right-hand interlocking flat bar 1020B may comprise a top cylindrical tube 1028B at one end and a bottom cylindrical tube 1030B at the other end.

Top cylindrical tube 1028B may be disposed on the topside of right-hand interlocking flat bar 1020B and may allow anchoring cylindrical core bar 1016 to be placed within top cylindrical tube 1028B so that anchoring cylindrical core bar 1016 may rotate 360 degrees along path V. Bottom cylindrical tube 1030B may be disposed on the underside of right-hand interlocking flat bar 1020B and may allow right-hand cylindrical core bar 1014 to be placed within bottom cylindrical tube 1030B so that right-hand cylindrical core bar 1014 may rotate 360 degrees along path V'. Bottom cylindrical tube 1030B may be secured to arcuate cylindrical core bar 1018B.

Right-hand cylindrical core bar 1014 may comprise an interior handle 1036A. Interior handle 1036A may be disposed at half the length of right-hand cylindrical core bar 1014 and may be used to protect an individual's fingers during exercise. Anchoring cylindrical core bar 1016 may be connected to left-hand cylindrical core bar 1012 via left-hand interlocking flat bar 1022A at one end and left-hand interlocking flat bar 1022B at the other end.

Left-hand interlocking flat bar 1022A may comprise a hinge 1038A at one end and a bottom cylindrical tube 1040A at the other end. Hinge 1038A may be attached to one end of top cylindrical tube 1028A so as to allow right-hand interlocking flat bar 1020A to rotate along path W. Bottom cylindrical tube 1040A may be disposed on an underside of left-hand interlocking flat bar 1022A and may allow left-hand cylindrical core bar 1012 to be placed within bottom cylindrical tube 1040A so that left-hand cylindrical core bar 1012 may rotate 360 degrees along path V". Bottom cylindrical tube 1040A may be secured to arcuate cylindrical core bar 1018A. Left-hand interlocking flat bar 1022B may comprise a hinge 1038B at one end and a bottom cylindrical tube 1040B at the other end. Hinge 1038B may be attached to one end of top cylindrical tube 1028B so as to allow right-hand interlocking flat bar 1020B to rotate along path W'. Bottom cylindrical tube 1040B may be disposed on an underside of left-hand interlocking flat bar 1022B and may allow left-hand cylindrical core bar 1012 to be placed within bottom cylindrical tube 1040B so that left-hand cylindrical core bar 1012 may rotate 360 degrees along path V". Left-hand cylindrical core bar 1012 may comprise a cylindrical arcuate hole 1032B at one end so that arcuate cylindrical core bar 1018B may pass through. Bottom cylindrical tube 1040B may comprise an arcuate hole 1034B so that arcuate cylindrical core bar 1018B may pass through. Left-hand cylindrical core bar 1012 may terminate before arcuate hole 1034B within bottom cylindrical tube 1040B so that arcuate cylindrical core bar 1018B may pass beyond left-hand cylindrical core bar 1012 and through arcuate hole 1034B. Left-hand cylindrical core bar 1012 may comprise an interior handle 1036B. Interior handle 1036B may be disposed at about half the length of left-hand cylindrical core bar 1012 and may be used to protect an individual's fingers during exercise. Arcuate cylindrical core bar 1018A may comprise a compression spring 1042A that may be engaged to add additional resistance training. Arcuate cylindrical core bar 1018B may comprise a compression spring 1042B that may be engaged to add additional resistance training to exercise.

Alternatively, the apparatus 1010 may comprise one or more firm compression springs bridging the length between the right-hand cylindrical core bar and the left-hand cylindrical core bar. The firm compression springs may make the arcuate cylindrical core bars seen in FIG. 36 redundant and unnecessary.

Figure 37:
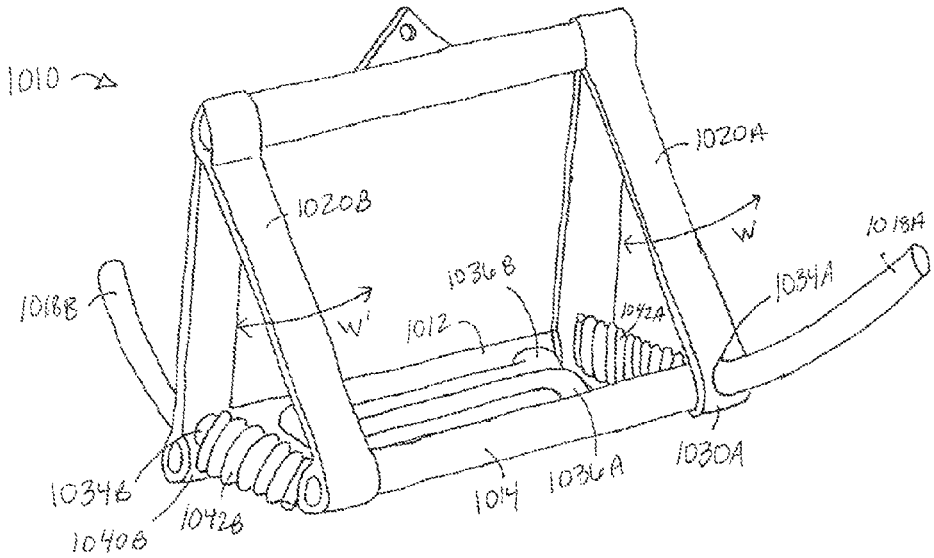
FIG. 37 illustrates a perspective view of a v-grip compression bar with additional resistance training components fully compressed via adduction.

As shown in FIG. 37, an alternate view of apparatus 1010 is shown and described. Arcuate cylindrical core bar 1018A may remain static as right-hand cylindrical core bar 1014 is moved towards left-hand cylindrical core bar 1012. Right-hand interlocking flat bar 1020A may rotate along path W, engaging compression spring 1042A with bottom cylindrical tube 1030A, and allowing arcuate cylindrical core bar 1018A to pass through arcuate hole 1034A. Arcuate cylindrical core bar 1018B may move dependently with right-hand interlocking flat bar 1020B as right-hand interlocking flat bar 1020B rotates along path W', engaging compression spring 1042B with bottom cylindrical tube 1040B, and allowing arcuate cylindrical core bar 1018B to pass through arcuate hole 1034B. Motion of right-hand interlocking flat bar 1020A through path W and motion of right-hand interlocking flat bar 1020B through path W' may terminate when contact is made between interior handle 1036A and interior handle 1036B.

Figure 38:
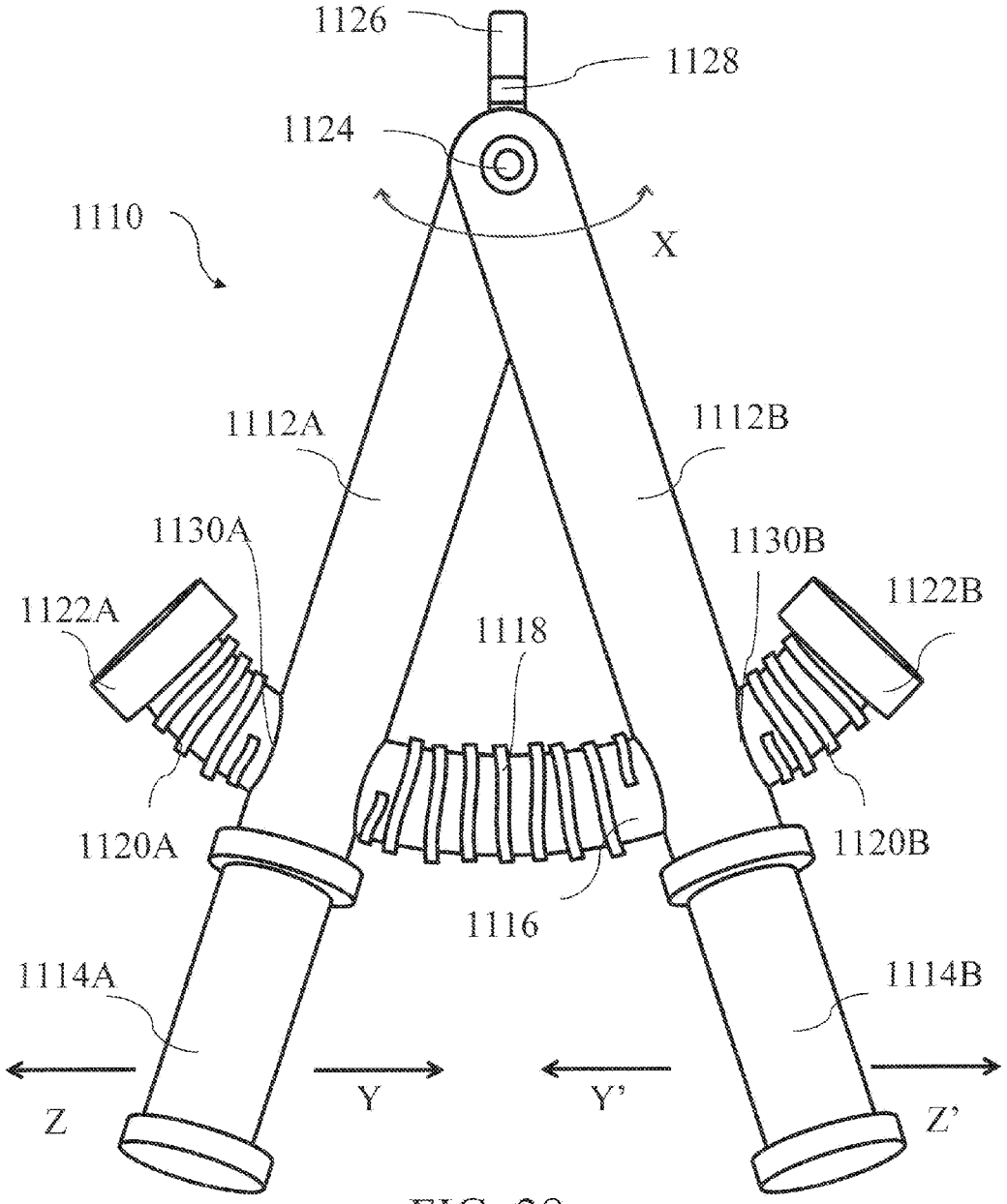
FIG. 38 illustrates a perspective view of a v-grip bar with additional resistance training components capable of both adduction and abduction in an alternate embodiment of the present invention.

As shown in FIG. 38, an alternate embodiment of a V-bar apparatus 1110 is shown and described in an alternate embodiment of the present invention. The apparatus 1110 may comprise a left-hand cylindrical core bar 1112A, a right-hand cylindrical core bar 1112B, a left-hand grip 1114A, a right-hand grip 1114B, an arcuate cylindrical core bar 1116, an adduction compression spring 1118, a left-hand abduction compression spring 1120A, a right-hand abduction compression spring 1120B, a left-hand end cap 1122A, and a right-hand end cap 1122B. Left-hand cylindrical core bar 1112A may be connected to right-hand cylindrical core bar 1112B via an axle 1124 passed through one end of both left-hand cylindrical core bar 1112A and right-hand cylindrical core bar 1112B. The axle 1124 may allow left-hand cylindrical core bar 1112A and right-hand cylindrical core bar 1112B to rotate freely and independently around axle 1124. Axle 1124 may comprise an eye hook 1126. Eye hook 1126 may be connected to a cable (not shown) via a carabineer clip (not shown) or other linking device known to one in the art. The cable (not shown) may be attached to a weight stack (not shown) to allow isotonic weight training. Eye hook 1126 may comprise a spindle 1128 that may allow apparatus 1110 to rotate 360 degrees along path X.

Left-hand cylindrical core bar 1112A may comprise an arcuate cylindrical hole 1130A to allow arcuate cylindrical core bar 1116 to passed through. Right-hand cylindrical core bar 1112B may comprise an arcuate cylindrical hole 1130B to allow arcuate cylindrical core bar 1116 to passed through. Left-hand grip 1114A may stet one end of left-hand cylindrical core bar 1112A opposite of axle 1124. Right-hand grip 1114B may stet one end of right-hand cylindrical core bar 1112B opposite of axle 1124. Arcuate cylindrical core bar 1116 may be passed through arcuate cylindrical hole 1130A and arcuate cylindrical hole 1130B simultaneously. Adduction compression spring 1118 may be disposed about arcuate cylindrical core bar 1116 and span the length between left-hand cylindrical core bar 1112A and right-hand cylindrical core bar 1112B. Left-hand cylindrical core bar 1112A may adduct along path Y and engage adduction compression spring 1118. Right-hand cylindrical core bar 1112B may adduct along path Y' and engage adduction compression spring 1118. Arcuate cylindrical core bar may terminate on one end with left-hand end cap 1122A and on other end with right-hand end cap 1122B.

Left-hand abduction compression spring 1120A may be disposed about arcuate cylindrical core bar 1116 and span the length between left-hand end cap 1122A and left-hand cylindrical core bar 1112A. Right-hand abduction compression spring 1120B may be disposed about arcuate cylindrical core bar 1116 and span the length between right-hand end cap 1122B and right-hand cylindrical core bar 1112B. Left-hand cylindrical core bar 1112A may abduct along path Z and engage left-hand abduction compression spring 1120A. Right-hand cylindrical core bar 1112B may abduct along path Z' and engage right-hand abduction compression spring 1120B. Abduction and adduction exercises of left-hand cylindrical core bar 1112A and right-hand cylindrical core bar 1112B may be done simultaneously or independently.

Figure 39:
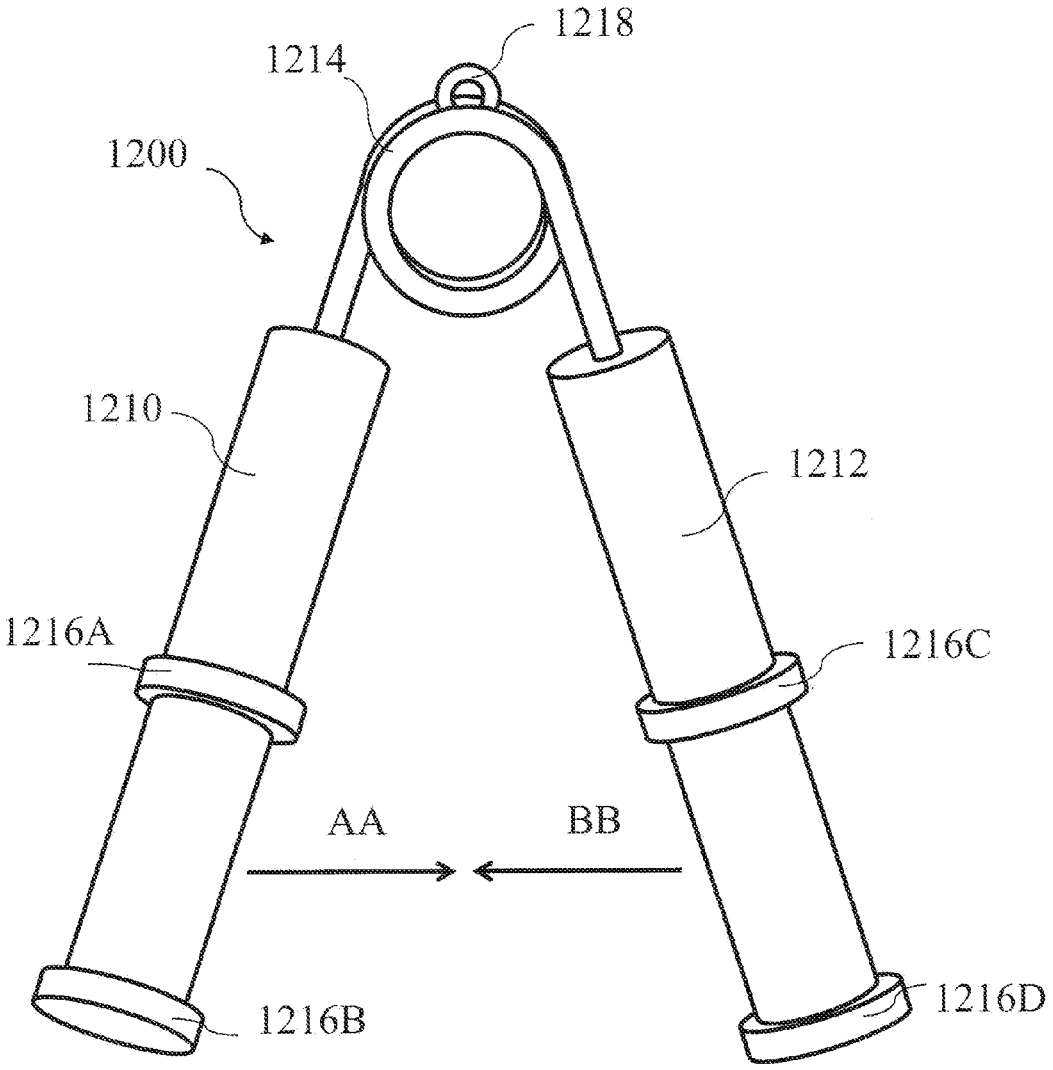
FIG. 39 illustrates a perspective view of a v-grip bar with additional resistance training components capable of adduction in an alternate embodiment of the present invention.

Referring now to FIG. 39, an alternate embodiment of a v-grip bar is shown and described. The v-grip bar apparatus 1200 may be capable of adduction. Apparatus 1200 may comprise a left-hand grip 1210 on one end, a right-hand grip 1212 on an opposite end, and a torsion spring 1214 spanning the length between left-hand grip 1210 and right-hand grip 1212. Left-hand grip 1210 may move inwardly along path AA while right-hand grip 1212 may move inwardly along path BB during a repetition. As left-hand grip 1210 and right-hand grip 1212 move inwardly during a repetition, torsion spring 1214 may be engaged, adding additional resistance throughout the contraction of the specific muscle or muscle group of the user. Left-hand grip 1210 and right-hand grip 1212 may be held at a top end or a bottom end during a repetition. Left-hand grip 1210 may comprise of a plurality of non-slip hand stops 1216A, 1216B and right-hand grip 1212 may comprise of a plurality of non-slip hand stops 1216C, 1216D.

Non-slip hand stop 1216A may prevent the left hand of a user from slipping from top end of left-hand grip 1210 while non-slip hand stop 1216B may prevent the left hand of a user from slipping from bottom end of left-hand grip 1210. Non-slip hand stop 1216C may prevent the right hand of a user from slipping from top end of right-hand grip 1212 while non-slip hand stop 1216D may prevent the right hand of a user from slipping from bottom end of right-hand grip 1212. A repetition performed with the left hand of a user at the top end of left-hand grip 1210 and the right hand of a user at the top end of right-hand grip 1212 may have a higher difficulty of completion and a larger impact on strength training.

Torsion spring 1214 may comprise an attaching loop 1218 that may be able to attach to a cable and pulley system for isotonic strength training. The torsion spring 1214 may be of any length and have any number of loops such that during a repetition the resistance of torsion spring 1214 increases with the amount of force applied. Apparatus 1200 may be used in isotonic strength training, specifically triceps push-downs, but is not limited to this exercise. Apparatus 1200 may be pushed downwardly when attached to a cable and pulley system and may lift a weight stack (not shown). As the weight stack (not shown) is lifted by a user, apparatus 1200 may be adducted, engaging torsion spring 1214, and providing additional resistance training throughout the contraction of the muscles of the user.

Figure 40:
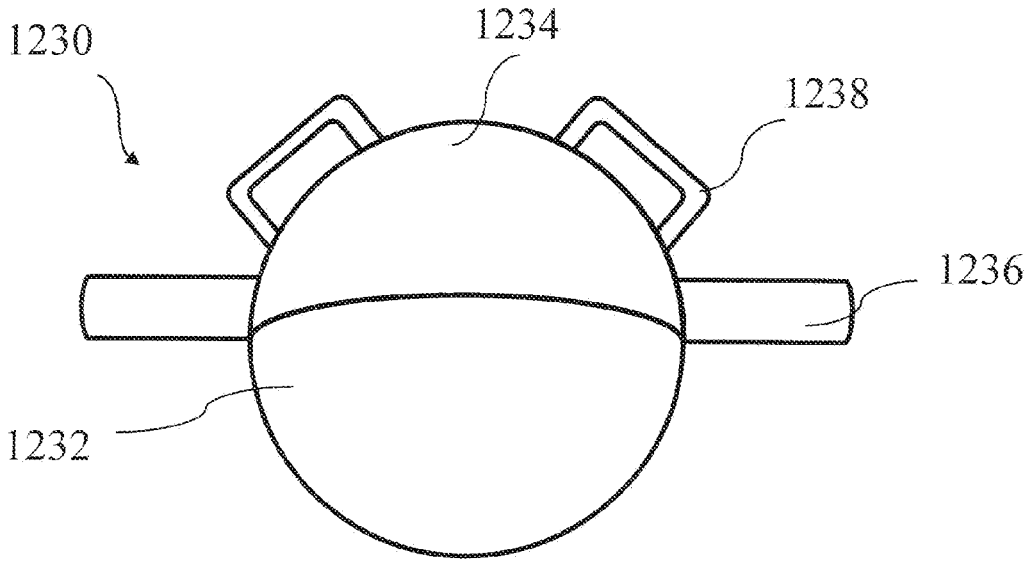
FIG. 40 illustrates a perspective view of an abdominal roller in an alternate embodiment of the present invention.

As shown in FIG. 40, an abdominal roller apparatus 1230 is shown and described in an alternate embodiment of the present invention. The abdominal roller apparatus 1230 may be used multi-directionally along the floor or alternate flat surface. The apparatus 1230 may comprise a ball 1232 and a socket device 1234. The socket device 1234 may be placed on top of ball 1232 allowing for the socket device 1234 to move freely on top of ball 1232. The socket device 1234 may rotate in any direction on top of ball 1232 while ball 1232 is stationary or in motion. The socket device 1234 may allow ball 1232 to rotate freely beneath socket device 1234 allowing the apparatus 1230 to move across a floor or alternate flat surface. Ball 1232 may rotate in any direction allowing apparatus 1230 to move forwards, backwards, sideways, diagonally, arcuate, and any combination thereof. Socket device 1234 may comprise a plurality of side grips 1236 and a plurality of top grips 1238. Side grips 1236 and top grips 1238 may be used by a user to hold apparatus 1230 when utilizing the same. For example, side grips 1236 may be used with an overhand grip, an underhand grip, or a combination thereof depending on the desired exercise. Top grips 1238 may be used with an overhand grip, an underhand grip, or a combination thereof depending on the desired exercise. Top grips 1238 may additionally allow a user to palm the socket device 1234 itself while preventing a user's hands from shifting positions. The freely rotating ability of the apparatus 1230 may allow a user to increase balance, strength, and stabilization throughout the user's workout.

Apparatus 1230 may be used in combination with a resistance band (not shown). The resistance band (not shown) may be attached to side grips 1236 or top grips 1238 on one end and attached to a user's knees or feet on an opposite end. The resistance band (not shown) may also be attached to side grips 1236 or top grips 1238 on both ends. A user may then place a length of the resistance band (not shown) behind the user's knees or feet, creating two smaller resistance bands and increasing the effective resistance. A user may push apparatus 1230 away from himself or herself, stretching the resistance band (not shown), and thereby increasing resistance during contraction of the muscle through the repetition. Apparatus 1230 may be used differently in combination with a resistance ban that increases the resistance during the contraction of muscles during the repetition.

Figure 41:
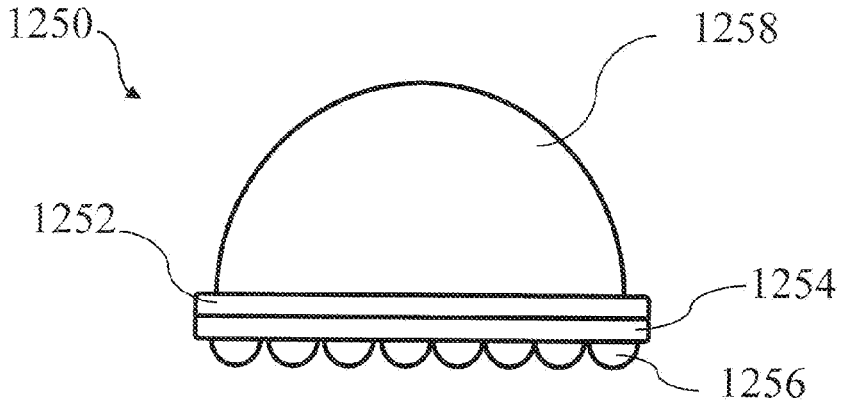
FIG. 41 illustrates a side view of a push-up apparatus in an alternate embodiment of the present invention.

Referring now to FIG. 41, a push-up apparatus 1250 is shown and described in an alternate embodiment of the present invention. The push-up apparatus 1250 may be used multi-directionally along the floor or alternate flat surface during push-up exercises. The push-up apparatus 1250 may comprise a core grip 1252, a bearing carriage 1254, a plurality of ball bearings 1256, and a soft cover 1258. The plurality of ball bearings 1256 may allow the push-up apparatus 1250 to move forwards, backwards, sideways, diagonally, arcuate, and any combination thereof. The core grip 1252 and bearing carriage 1254 may be made from a sturdy plastic, metal, or alternative strong material known to one skilled in the art that would support the body weight of a user. The soft cover 1258 may be made of a padded material, a foam, or alternate soft material known to one skilled in the art that may allow a user to comfortably grip the push-up apparatus 1250 within the user's hand.

Figure 42:
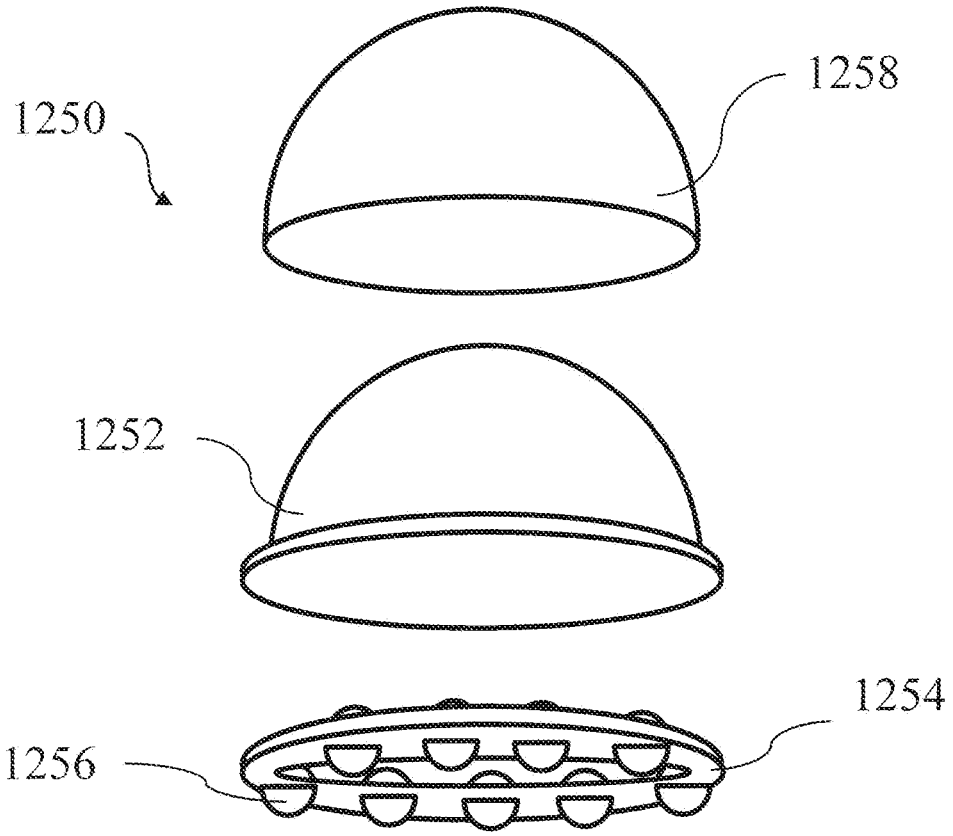
FIG. 42 illustrates an exploded view of the push-up apparatus in the alternate embodiment of the present invention.

As shown in FIG. 42, an exploded view of push-up apparatus 1250 is shown and described. The plurality of ball bearings 1256 may be secured within bearing carriage 1254 and may allow the bearing carriage 1254 to move forwards, backwards, sideways, diagonally, arcuately, and any combination thereof. Core grip 1252 may be permanently affixed to bearing carriage 1254 and may allow a user to harness the push-up apparatus 1250. The soft cover 1258 may be placed directly onto core grip 1252, creating a comforting grip surface for a user to manipulate.

An individual may use one or more push-up apparatuses 1250 to preform push-up exercises. For example, a user may grip a push-up apparatus 1250 in either hand and perform a push-up exercise. The plurality of ball bearings 1256 may create an additional need to balance and stabilize the user throughout the repetition. The additional need to balance and stabilize may increase the strength of a user's stabilization muscles along with the specific muscle group the push-up was intended to exercise. A user may rotate, extend, contract, or otherwise move the push-up apparatus 1250 during a repetition in order to focus on different muscle groups.

Push-up apparatus 1250 may be used in combination with a resistance band (not shown). For example, the resistance band (not shown) may be wrapped around a user's arms prior to exercise. As a user performs a push-up, the user may extend the push-up apparatus 1250 outwards, stretch the resistance band, and thereby increase the resistance during contraction of the muscle through the repetition. Push-up apparatus 1250 may be used in combination with a resistance band that increases the resistance during the contraction of muscles during the repetition.

Figure 43:
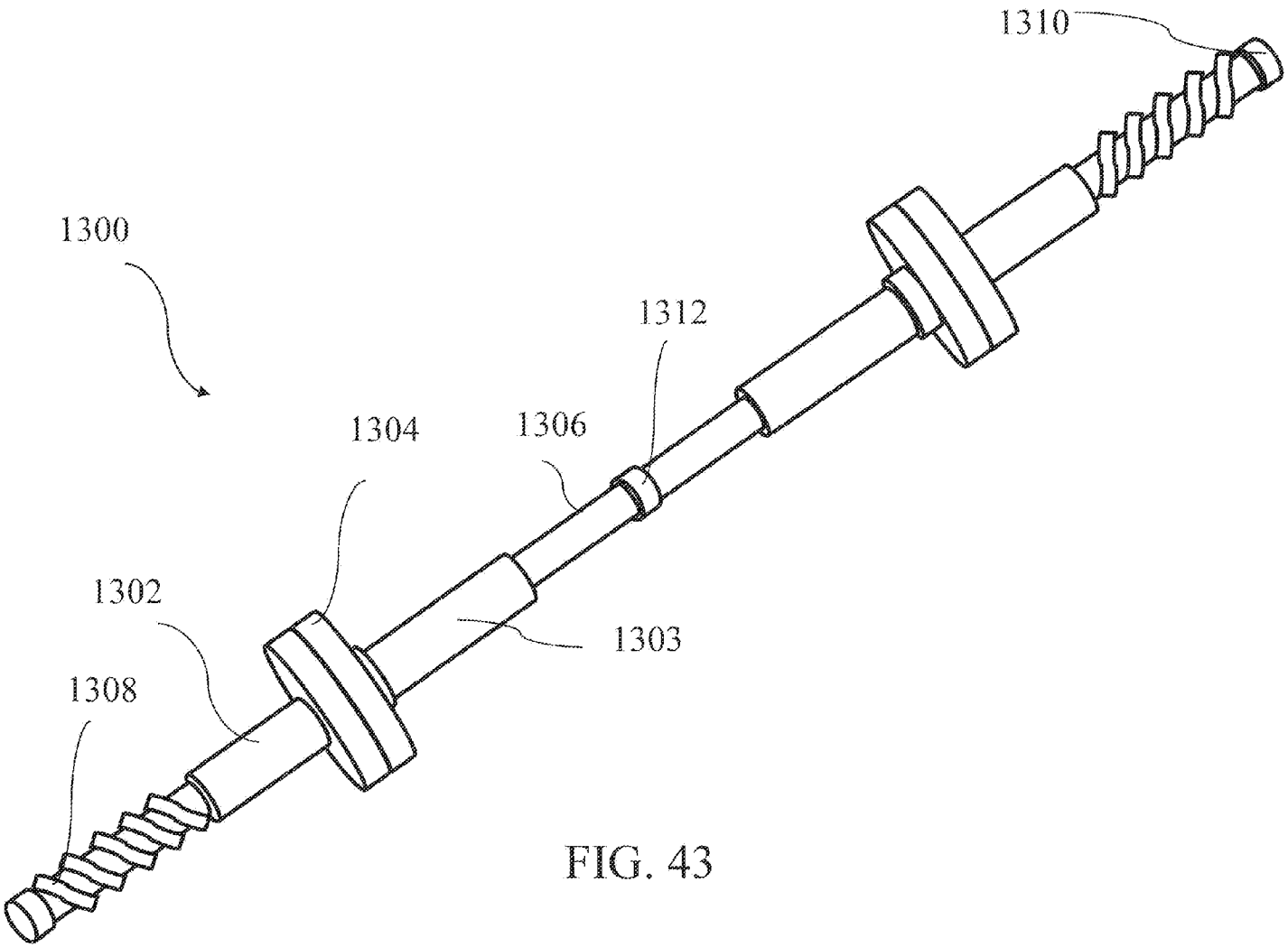
FIG. 43 illustrates a perspective view of a preferred embodiment of the present invention.
Figure 44:
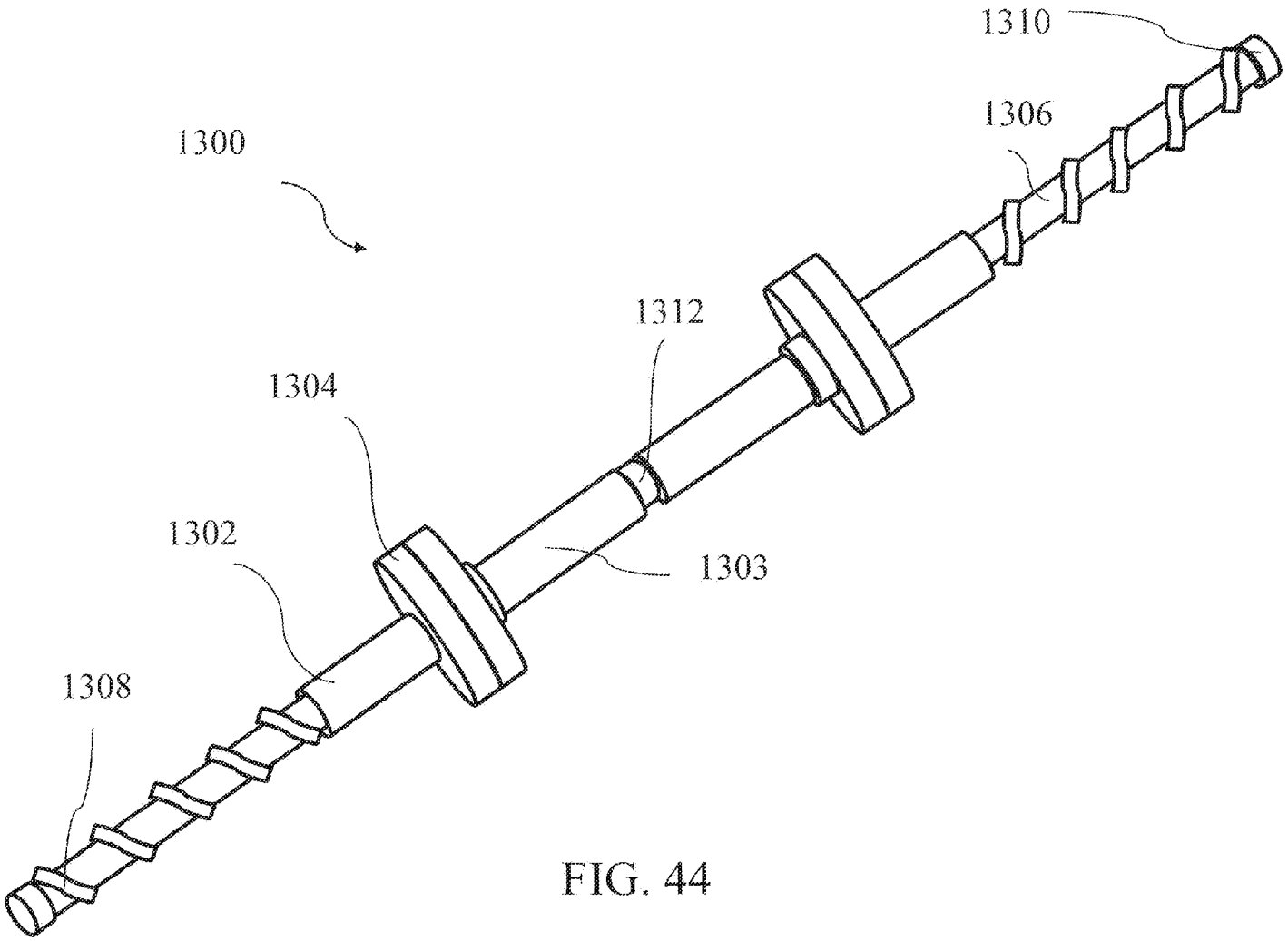
FIG. 44 illustrates a perspective view of a preferred embodiment of the present invention during adduction.
Figure 45:
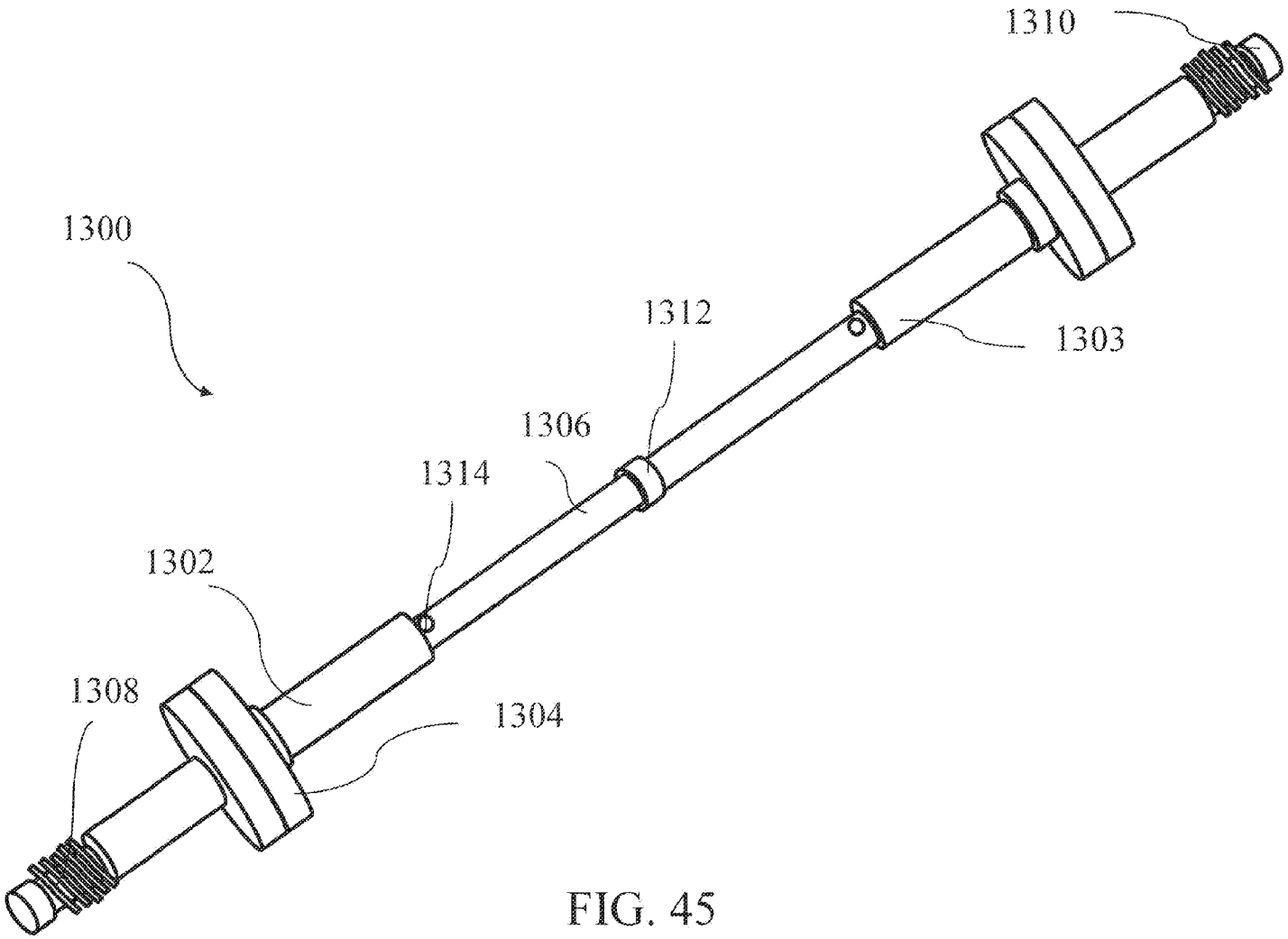
FIG. 45 illustrates a perspective view of a preferred embodiment of the present invention during abduction.

Referring now to FIGS. 43-45, a preferred embodiment is shown and described. Weight lifting apparatus 1300 may comprise a plurality of alternate mounting devices 1302. Alternate mounting device 1302 may work similarly to mounting device 14 shown and described in FIG. 1. Alternate mounting device 1302 may be comprised of a hand grip 1303 to allow a user to maneuver alternate mounting device 1302. A plurality of weight plates 1304 may be placed onto alternate mounting device 1302 much like any weight mounting device. Alternate mounting device 1302 may traverse a core bar 1306 and contact a spring 1308. Spring 1308 may be attached to alternate mounting device 1302 on one end and an end cap 1310 on another end. Spring 1308 may alternately be attached to alternate mounting device 1302 on one end and a center cap 1312 on another end. End cap 1310 may be removable and may withstand forces of spring 1308 when alternate mounting device 1302 engages spring 1308. When spring 1308 is attached to alternate mounting device 1302 and end cap 1310, a user may adduct the plurality of alternate mounting devices 1302 and stretch the plurality of springs 1302 thereby increasing adduction resistance as shown in FIG. 44. When spring 1308 is attached to alternate mounting device 1302 and end cap 1310, a user may abduct the plurality of alternate mounting devices 1302 and compress the plurality of springs 1302 thereby increasing abduction resistance as shown in FIG. 45. When spring 1308 is attached to alternate mounting device 1302 and center cap 1312, a user may adduct the plurality of alternate mounting devices 1302 and compress the plurality of springs 1302 thereby increasing adduction resistance. When spring 1308 is attached to alternate mounting device 1302 and center cap 1312, a user may abduct the plurality of alternate mounting devices 1302 and stretch the plurality of springs 1302 thereby increasing abduction resistance.

Figure 46:
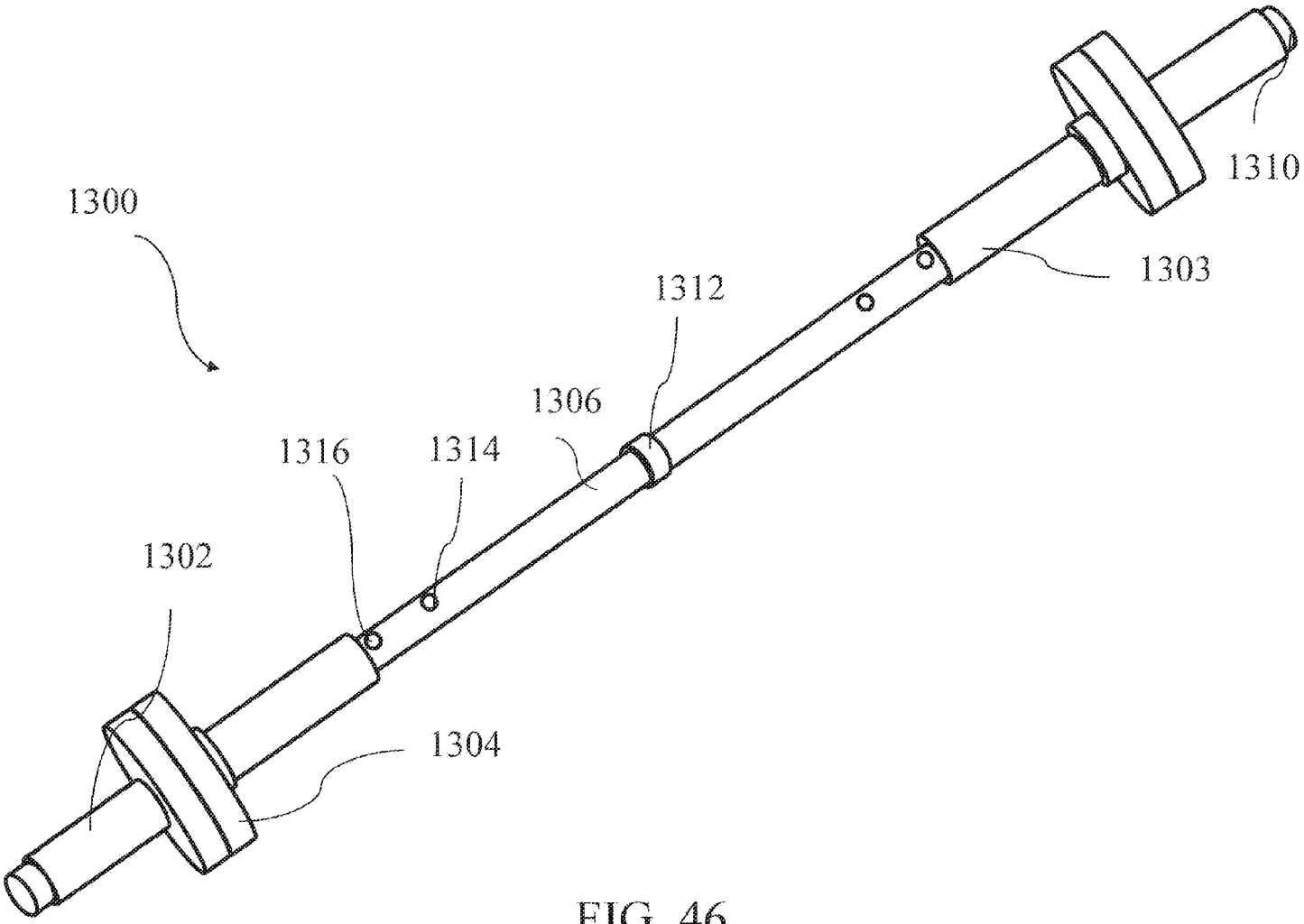
FIG. 46 illustrates an alternate embodiment of the present invention with resistance training components removed.

In FIGS. 45-46, a plurality of locking holes 1314, 1316 are shown and described. As shown in FIG. 45, locking holes 1314 may be exposed when user abducts weight lifting apparatus 1300 and completely compresses springs 1308. As shown in FIG. 46, locking holes 1316 may be exposed when springs 1308 are removed and user abducts weight lifting apparatus 1300. Locking holes 1314, 1316 may be used by inserting locking pins (not shown) to hold alternative mounting device 1302 in an abduction position. Alternatively, spring loaded push buttons (not shown) may be disposed within locking holes 1314, 1316 and may pop out of locking holes 1314, 1316 when alternate mounting device 1302 traverses past locking holes 1314, 1316. Spring loaded push buttons (not shown) may withstand the force of spring 1308 along with the added weight of weight plates 1304. Spring loaded push buttons (not shown) may also be pressed down by a user to move alternate mounting devices 1302 and return weight lifting apparatus 1300 to normal operation.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. An apparatus for exercise and resistance training, the apparatus comprising:

a weight lifting bar comprising a main body portion having a longitudinal axis, and further having a first end, a center, and a second end;

a first spring between the first end and the center;

a first hand grip disposed adjacent the first spring and movable on the longitudinal axis of the main body portion, the first hand grip disposed between the first spring and the center;

a second spring between the center and the second end; and a second hand grip disposed adjacent the second spring and movable on the longitudinal axis of the main body portion, the second hand grip disposed between the center and the second spring;

a third spring disposed between the first hand grip and the center; and a fourth spring disposed between the center and the second hand grip.

2. The apparatus of claim 1 further comprising:

a first weight mount at the first end; and a second weight mount at the second end.

3. The apparatus of claim 1 further comprising:

a first end cap at the first end; and a second end cap at the second end.

4. The apparatus of claim 1 further comprising:

a first roller disposed at the first end; and a second roller disposed at the second end, said first and second rollers for contacting a surface and allowing the apparatus to roll on the surface.

5. The apparatus of claim 1 further comprising:

a first stand disposed at the first end; and a second stand disposed at the second end, said first and second stands for contacting a surface and holding the apparatus above the surface.

6. The apparatus of claim 1 wherein the first hand grip is between the first end and the first spring and the second hand grip is between the second spring and the second end.

7. The apparatus of claim 1 wherein the first hand grip is connected to the first spring and the second hand grip is connected to the second spring.

8. The apparatus of claim 1 wherein the main body portion contains a first locking mechanism to secure the first hand grip, preventing the first hand grip from moving longitudinally along the main body portion, and a second locking mechanism to secure the second hand grip, preventing the second hand grip from moving longitudinally along the main body portion.

9. The apparatus of claim 1 wherein the main body portion is a solid bar.

10. The apparatus of claim 1 wherein the main body portion comprises:

a first partial cylindrical portion;

a second partial cylindrical portion; and a space between the first partial cylindrical portion and the second partial cylindrical portion, wherein a complete cylinder is formed when the first partial cylindrical portion faces the second partial cylindrical portion across the space between the first partial cylindrical portion and the second partial cylindrical portion.

11. The apparatus of claim 10 wherein:

on the first end, the first hand grip surrounds the first partial cylindrical portion, the second partial cylindrical portion, and the length between the first partial cylindrical portion and the second partial cylindrical portion, and contains a first bolt that traverses the length between the first partial cylindrical portion and the second partial cylindrical portion; and on the second end, the second hand grip surrounds the first partial cylindrical portion, the second partial cylindrical portion, and the length between the first partial cylindrical portion and the second partial cylindrical portion and contains a second bolt that traverses the length between the first partial cylindrical portion and the second partial cylindrical portion.

12. The apparatus of claim 1 wherein at least one of the first hand grip and the second hand grip rotate about the longitudinal axis of the main body portion.

13. The apparatus of claim 1 wherein at least one of the first hand grip and the second hand grip rotate about the lateral axis of the main body portion.

14. The apparatus of claim 1 further comprising:

a first attaching device disposed on the first hand grip;

a center attaching device disposed at the center; and a second attaching device disposed on the second hand grip.

15. A method for exercise and resistance training, the method comprising the steps of:

providing a weight lifting bar comprising a main body portion having a longitudinal axis, and further having a first end, a center, and a second end, a first spring between the first end and the center, a first hand grip disposed adjacent the first spring and movable longitudinally along the main body portion, said first hand grip disposed between the first spring and the center, a second spring between the center and the second end, and a second hand grip disposed adjacent the second spring and movable longitudinally along the main body portion, said second hand grip disposed between the center and the second spring, a third spring between the first hand grip and the center, and a fourth spring between the center and the second hand grip;

beginning a repetition with weight lifting bar;

compressing at least one of the first spring and the second spring during muscle contraction;

disengaging at least one of the first spring and the second spring during muscle regression; and completing the repetition.

16. The method of claim 15 further comprising the steps of:

extending at least one of the first spring and the second spring during muscle contraction; and disengaging at least one of the first spring and the second spring during muscle regression.

17. The method of claim 15 further comprising the steps of:

attaching a resistance band between the first hand grip and the center;

attaching a resistance band between the second hand grip and the center;

engaging the resistance bands during muscle contraction; and disengaging the resistance bands during muscle regression.

18. The method of claim 15 further comprising the step of:

removing an end from apparatus;

removing a hand grip from apparatus;

removing a spring from apparatus;

replacing the hand grip on apparatus;

replacing the spring on apparatus; and replacing the end on the apparatus.

* * * * *